US007600760B2

(12) United States Patent
Matsuda et al.

(10) Patent No.: US 7,600,760 B2
(45) Date of Patent: Oct. 13, 2009

(54) PRIZE ACQUISITION GAME MACHINE AND PRIZE PLACING BASE

(75) Inventors: Takashi Matsuda, Tokyo (JP); Junichi Murakami, Tokyo (JP)

(73) Assignee: Kabushiki Kaisha Sega, Tokyo (JP)

( * ) Notice: Subject to any disclaimer, the term of this patent is extended or adjusted under 35 U.S.C. 154(b) by 255 days.

(21) Appl. No.: 11/864,502

(22) Filed: Sep. 28, 2007

(65) Prior Publication Data

US 2008/0090629 A1 Apr. 17, 2008

(30) Foreign Application Priority Data

Oct. 13, 2006 (JP) ..... 2006-280748
Sep. 18, 2007 (JP) ..... 2007-241361

(51) Int. Cl.
*A63F 9/00* (2006.01)

(52) U.S. Cl. ..... 273/447

(58) Field of Classification Search ..... 273/440, 273/447, 448; 221/208
See application file for complete search history.

(56) References Cited

U.S. PATENT DOCUMENTS 7,549,646 B2 * 6/2009 Yumiya ..... 273/448
2003/0011133 A1 * 1/2003 Uedono et al. ..... 273/447
2008/0090629 A1 * 4/2008 Matsuda et al. ..... 463/7
2008/0242413 A1 * 10/2008 Matsuda ..... 463/38

FOREIGN PATENT DOCUMENTS

JP 2005-152591 6/2005
JP 2005143682 A * 6/2005
JP 2008114047 A * 5/2008

* cited by examiner

*Primary Examiner*—Raleigh W. Chiu
(74) *Attorney, Agent, or Firm*—Seed IP Law Group PLLC

(57) ABSTRACT

The present invention provides a prize acquisition game machine capable of enhancing interest of players to play the game compared to conventional prize acquisition game machines. In a prize acquisition game machine having a configuration in which a prize falls off from a placing surface of a prize placing base to be paid out by an extension/contraction operation in a fore-and-aft direction of an arm member which is movable in an operation plane by the player's operation, there is provided a rocking mechanism for rocking the prize placing base in the fore-and-aft direction between the prize placing base and a support member supporting the prize placing base such that the prize placing base rocks in the fore-and-aft direction by a function of the rocking mechanism when the arm member is brought into contact with the prize placed on the prize placing base.

13 Claims, 16 Drawing Sheets

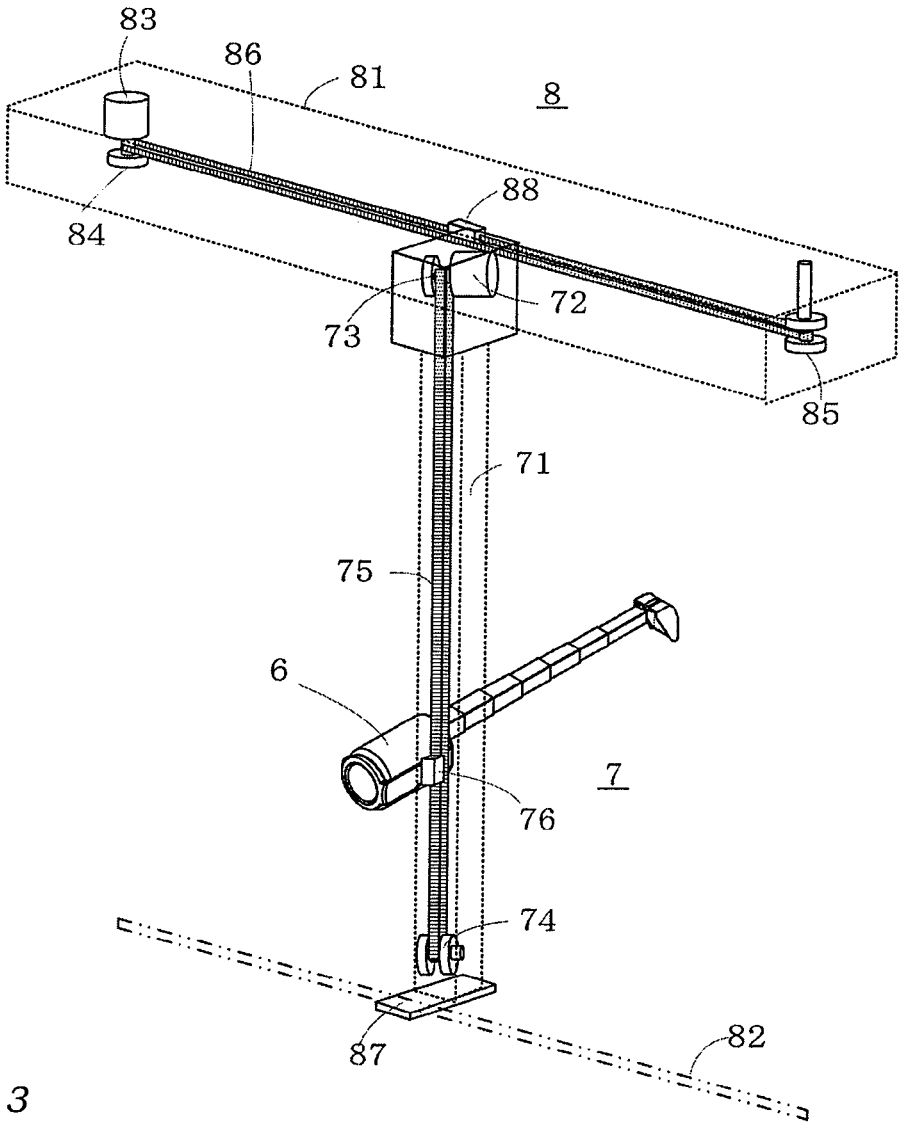
*Fig. 3*
*Fig. 4*
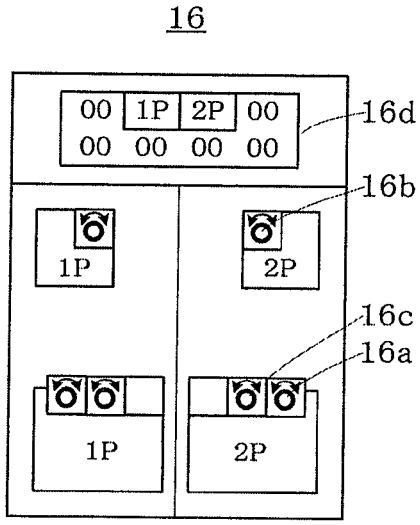

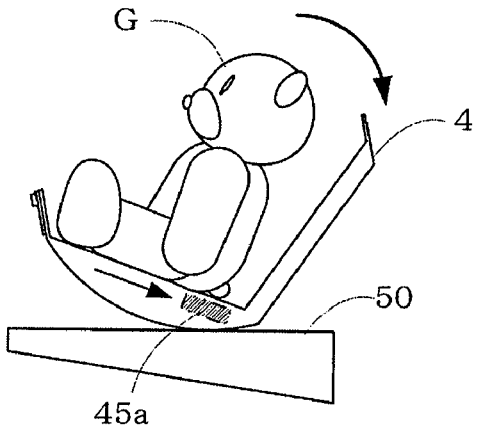
Fig. 9A
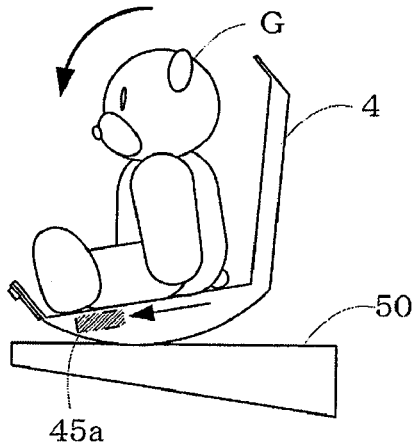
Fig. 9B
Fig. 10A
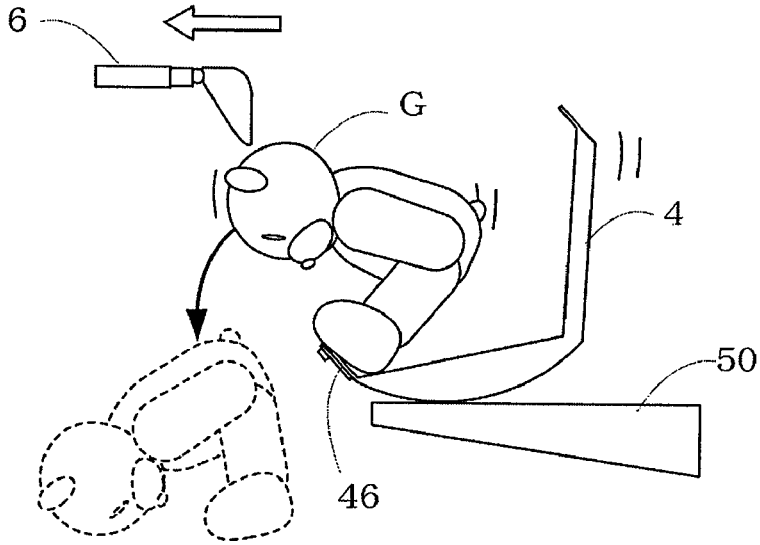
Fig. 10B
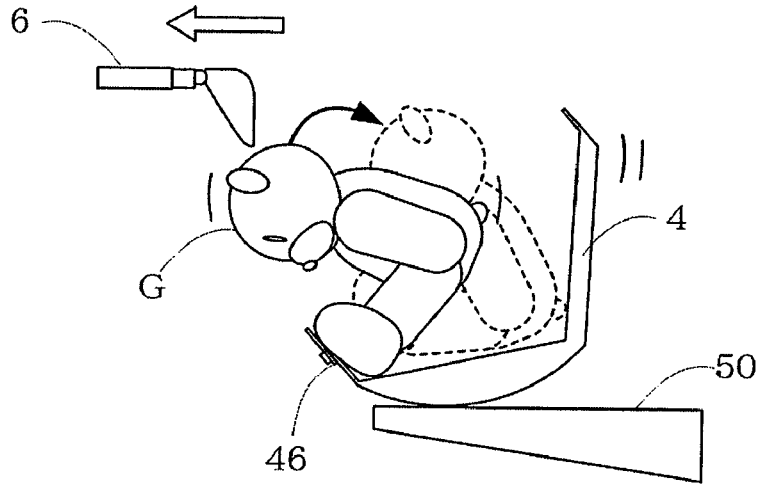

PRIZE ACQUISITION GAME MACHINE AND PRIZE PLACING BASE

BACKGROUND

1. Technical Field

The present invention relates to a prize acquisition game machine having a structure in which, by an extension/contraction operation of an arm member which is operated to move by a player, a prize is allowed to fall off from a prize placing portion to be paid out, and more particularly, to a prize acquisition game machine capable of raising a sense of expectation of the player for prize acquisition.

2. Description of the Related Art

Hitherto, there is known a prize acquisition game machine to be installed in amusement facilities such as amusement spaces, and having a structure in which, by a drawing operation of an arm member operated by a player, a prize is allowed to fall off from a prize placing base to be paid out (see, for example, Japanese Patent Laid-Open Publication No. 2005-152591).

The prize acquisition game machine described above has the following structure. That is, the prize is placed on the prize placing base which is slidable in a forward direction and a backward direction, a locking member mounted to an end of the arm member is allowed to lock a target member attached to the prize placing base to draw the target member forward, and when the target member can be drawn to a position where the prize placing base is inclined, the prize falls off to be paid out.

However, the prize acquisition game machine described above has a problem in that, when locking between the target member and the locking member fails, no movement (reaction) of the prize occurs. Further, even when the locking succeeds, unless the target member can be drawn to the position where the prize placing base is inclined, the prize does not move to a large degree.

That is, according to the conventional prize acquisition game machine described above, at a time of failure of the prize acquisition, a degree of movement of the prize is remarkably small. Accordingly, there is a problem in that the conventional prize acquisition game machine does not provide such a game performance that allows the player to have a sense of expectation that the player can almost acquire the prize ("sense of almost acquiring").

BRIEF SUMMARY

The present invention has been made in view of the above-mentioned problem. According to the present invention, at least one of the following objects is achieved.

That is, it is an object of the present invention to provide a prize acquisition game machine capable of enhancing interest of players to play compared to the above mentioned conventional prize acquisition game machine.

It is another object of the present invention to provide a prize acquisition game machine capable of giving a larger sense of expectation for prize acquisition to the player.

It is still another object of the present invention to provide a prize acquisition game machine capable of raising a degree or a probability of moving the prize even when the prize acquisition fails.

It is yet another object of the present invention to provide a prize acquisition game machine capable of easily adjusting a difficulty level of the prize acquisition.

It is still another object of the present invention to provide a prize acquisition game machine capable of adjusting a difficulty level of the prize acquisition in a manner that the player can recognize the difficulty level.

The present invention has been made to solve the above-mentioned problem, and the present invention provides a prize acquisition game machine, including:

an arm member operated to move by a player;

a prize placing base having a placing surface on which a prize is placed, the prize falling off from the placing surface to be paid out due to an extension/contraction operation in a fore-and-aft direction of the arm member;

a support member for supporting the prize placing base; and a rocking mechanism provided between the prize placing base and the support member, for rocking the prize placing base in the fore-and-aft direction, in which, when the arm member is brought into contact with the prize placed on the prize placing base, due to a function of the rocking mechanism, the prize placing base rocks in the fore-and-aft direction (first aspect), or a prize placing base arranged on a support surface formed on a support member in a prize acquisition game machine in which a prize falls off to be paid out due to a contact with an arm member performing an extension/contraction operation in a fore-and-aft direction, the prize placing base including:

a placing surface on which the prize is placed; and a leg portion attached to a lower side of the placing surface and having a contact surface curved in a convex shape, in which the prize placing base rocks on the support member by rolling with the contact surface of the leg portion being brought into contact with the support surface (thirteenth aspect).

According to the present invention, even in a case where the acquisition of the prize is not achieved, when the arm member is brought into contact with the prize placed on the prize placing base, the prize placing base rocks in the fore-and-aft direction. Therefore, as compared to conventional prize acquisition game machines, a degree of rocking of the prize can be made larger or a probability of rocking the prize can be increased. Accordingly, a sense of expectation of the player for possibility of prize acquisition can be increased, thereby making it possible to achieve an effect of enhancing interest of the players to play the game, for example.

Note that, the fore-and-aft direction according to the present invention can be set to a direction from a front side of a game machine casing to a back side thereof. A moving operation of the arm member by the player in this case can be performed on a plane perpendicular to the fore-and-aft direction.

The present invention may employ a structure in which: the prize placing base has a leg portion provided with a contact surface curved in a convex shape; the support member has a support surface for supporting the leg portion; the rocking mechanism includes the contact surface and the support surface; and the prize placing base rocks in the fore-and-aft direction by rolling with the contact surface being brought into contact with the support surface (second aspect). With this structure, the rocking mechanism can be realized by a simple structure.

The prize placing base in this case may have a single leg portion having a contact surface of a large width dimension, or two (or more) leg portions each having a contact surface of a small width dimension arranged side by side (third aspect).

In general, a curve of the contact surface according to the second or third aspect of the present invention may have an arcuate shape. However, as long as the prize placing base can smoothly roll on the support surface, the curve of the contact surface may be in any mode and have any curvature.

It is preferable to form, between the prize placing base and the support member according to the present invention, a rocking position fixing mechanism for fixing a rocking position of the prize placing base on the support surface (fourth aspect). This structure prevents the difficulty level of the prize acquisition intended by an installer of the machine from being changed by causing a setting position of the prize placing base or an orientation thereof to be shifted or changed every time the arm member is brought into contact with the prize or the prize placing base.

As a specific mode of the present invention, it is preferable that the support surface of the support member be provided with a rack on which a plurality of convexes and concaves are arranged in the fore-and-aft direction, and the contact surface of the leg portion of the prize placing base be provided with a gear on which a plurality of convexes and concaves engaging with the convexes and concaves of the rack are arranged along the curve.

In this structure, the prize placing base rolls in a state where the convexes and concaves of the rack and the convexes and concaves of the gear are engaged with each other.

According to the present invention, it is preferable that the prize placing base be formed with a first inclination angle adjusting mechanism for adjusting an inclination angle of the prize placing base in the fore-and-aft direction in an initial state (fifth aspect), the support member be formed with a second inclination angle adjusting mechanism for adjusting an inclination angle of the support surface in the fore-and-aft direction (sixth aspect), and/or the prize placing base further include a fall-off blocking member capable of adjusting an extension amount thereof from a front end of the placing surface in an upward direction (seventh aspect). With this structure, it is possible to easily perform setting of the difficulty level of the prize acquisition.

That is, the prize placing base in the initial state or the support surface is inclined backwardly or an extension height of the fall-off blocking member is made larger, thereby making it possible to make the prize acquisition be difficult. The prize placing base in the initial state or the support surface is inclined forward or the extension height of the fall-off blocking member is made smaller, thereby making it possible to make the prize acquisition be easy.

Further, in the fifth to seventh aspects of the present invention, the difficulty level can be set for each prize placing base or support member. Therefore, it is possible to perform detailed setting considering a price, popularity, or the like of the prize.

Further, in the fifth to seventh aspects of the present invention, the player can recognize the set difficulty level of the prize acquisition by viewing. Therefore, it is possible to reduce the player's distrust that the adjustment of the difficulty level is performed in an invisible manner from the players.

In the present invention, it is preferable that the prize placing base further include a back plate provided upwardly from a back end of the placing surface; the back plate have a front surface formed with a second placing surface on which the prize can be placed; and the back plate have a back surface formed with an engagement member for fixing the prize placing base to the support surface (eighth aspect).

According to the present invention, it is possible to select two ways of operation modes which differ from each other in easiness of the prize acquisition, mode of a movement of the prize, or the like between a case where the prize is placed on the placing surface with the leg portion being brought into contact with the support surface and a case where the prize is placed on the second placing surface with the prize placing base being fixed to the support surface by the engagement member of the back plate.

The prize placing base of the present invention may further include removable side plates which extends upright from both side ends of the placing surface (ninth aspect).

According to the present invention, side toppling of the prize on the placing surface can be prevented by the side plates, and by aligning two of the prize placing bases side by side and removing the side plates therebetween, the prize having a size which cannot be placed on a single prize placing base can be placed. Therefore, it is possible to increase diversity of the prize which can be used.

In the present invention, it is preferable that the placing surface of the prize placing base include a slip inhibition member arranged thereon, for inhibiting slippage of the prize (tenth aspect). With this structure, it is possible to suppress change in position or posture of the prize on the placing surface due to contact with the arm member, thereby making it possible to prevent change in difficulty level of the prize acquisition intended by the installer of the machine while the games are repeated.

The present invention may employ a structure in which: the prize placing base includes a rotation shaft extending in a horizontal direction; the support member includes a bearing for rotatably supporting the rotation shaft; the rocking mechanism includes the rotation shaft and the bearing; and the prize placing base rocks in the fore-and-aft direction by rotating about the rotation shaft (eleventh aspect), or a structure in which: the rocking mechanism includes at least one elongated suspension member having one end attached to the support member and another end attached to the prize placing base; and the prize placing base rocks in the fore-and-aft direction by being suspended by the at least one suspension member and performing a pendular movement (twelfth aspect). In this case as well, a degree of rocking of the prize or a probability of rocking the prize at the time the arm member is brought into contact with the prize can be increased. Accordingly, it is possible to raise a sense of expectation of the player for possibility of price acquisition, thereby enhancing interest of the players to play the game.

BRIEF DESCRIPTION OF THE SEVERAL VIEWS OF THE DRAWINGS

In the accompanying drawings:

FIG. 3 is an explanatory view showing a structure of a vertical movement device and a horizontal movement device;

FIG. 4 is an explanatory view showing an outside structure of a setting panel;

FIG. 9 are explanatory views showing modes of adjustment of an inclination angle of the prize placing base in a fore-and-aft direction in an initial state by the first inclination angle adjusting mechanism;

FIG. 10 are explanatory views showing modes of height adjustment of a fall-off blocking member;

DETAILED DESCRIPTION

Hereinafter, a description will be made of a preferred embodiment of the present invention with reference to the accompanying drawings.

Figure 1:
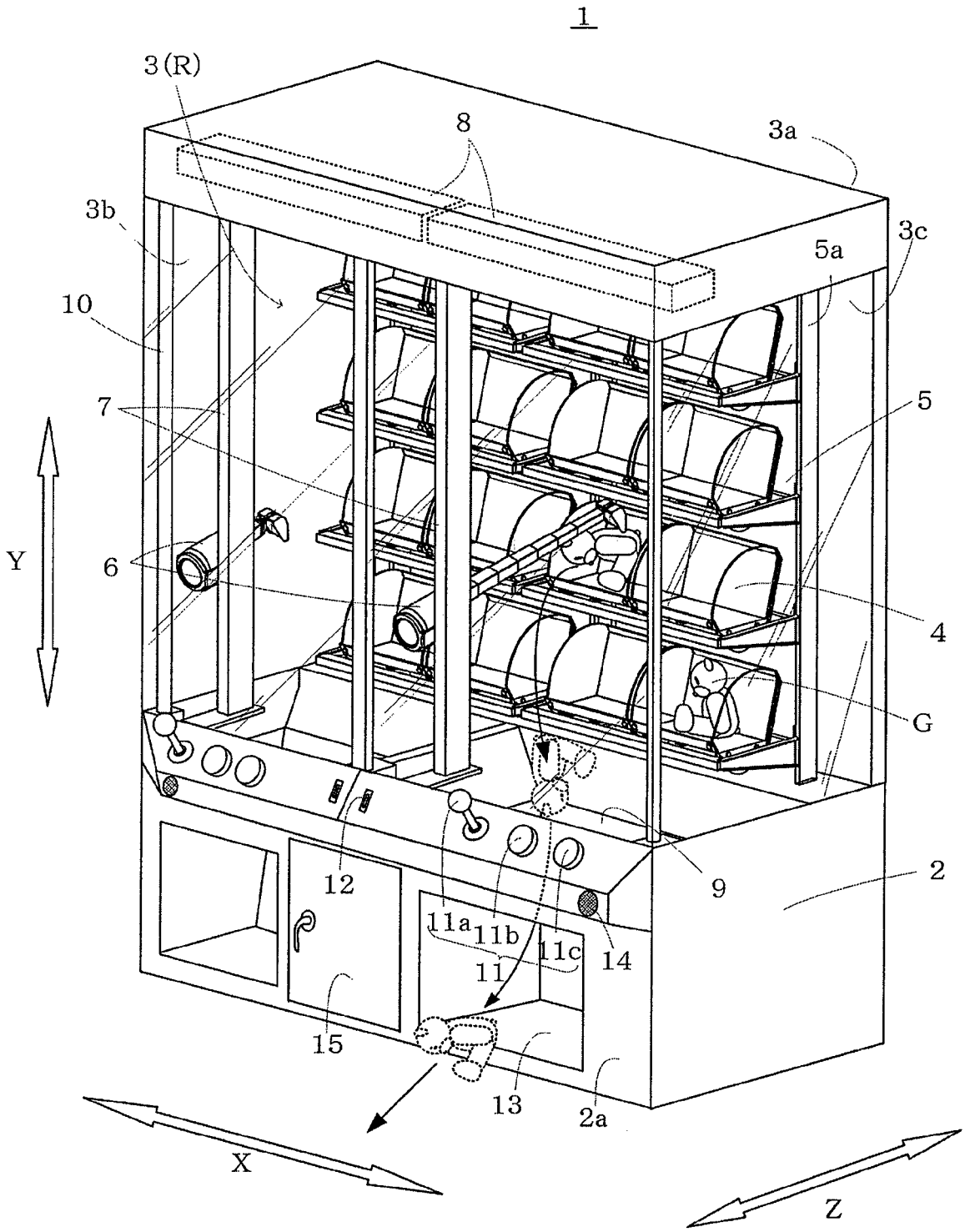
FIG. 1 is an explanatory view showing a structure of a prize acquisition game machine according to an embodiment of the present invention.

FIG. 1 is a view showing an outside structure of a prize acquisition game machine 1 to which the present invention is applied. The prize acquisition game machine 1 mainly includes a game machine main body portion 2 in which a main control board 20 or the like described later is accommodated and a prize chamber 3 in which a plurality of various prizes G (such as "stuffed dolls", "confectioneries" or "goods") are accommodated and a game space R for a prize acquisition game is formed.

In this case, a chamber wall of the prize chamber 3 includes a back wall 3*a* formed of an opaque plate member of metal or the like, a front wall 3*b* and right and left walls 3*c* formed of a transparent acrylic or glass member or the like so that the prizes G in the prize chamber 3 can be seen from an outside.

Further, in the prize chamber 3, there are provided a plurality of prize placing bases 4 on which the prizes G are placed, a multi-stage shelf portion 5 on which the plurality of prize placing bases 4 are placed, an arm member 6 used for allowing the prize to fall off from the prize placing base 4, a vertical movement device 7 and a horizontal movement device 8 for driving the arm member 6 on an operation plane (XY plane of FIG. 1), a prize fall-off opening 9 for delivering the fallen prize G to an outside the chamber 3, and an illumination device 10 such as a fluorescent lamp for illuminating the game space R.

The game machine main body portion 2 has, on a front wall 2*a* side thereof, an operation panel 11 including various operation members 11*a* to 11*c* for receiving operations of the player and operating the arm member 6 in the game space R, a coin slot 12 for receiving a game charge, a prize pay-out opening 13 communicating with the prize fall-off opening 9, and a speaker 14 for outputting game sounds such as background music (BGM). Further, a setting panel 16 for setting operating conditions for the arm member 6 is accommodated inside of an accommodation door 15 of the game machine main body portion 2.

Note that, FIG. 1 shows an exemplary mode in which, in order to enable two players to play the game at the same time, a set of the arm member 6, the prize fall-off opening 9, the operation panel 11, the coin slot 12, the prize pay-out opening 13, and the like is provided to each of a left part and a right part. However, in a case where a prize acquisition game machine for one player or three players is structured, one set or three sets of those may be provided.

FIG. 2 are explanatory views showing a structure of the arm member 6. FIGS. 2A and 2B are perspective views of the arm member 6 in a contraction state and an extension state, respectively. FIG. 2C is a side view of an internal structure of the arm member 6.

As shown in FIG. 2, the arm member 6 is provided with a device main body portion 61 mounted to the vertical movement device 7, an extension/contraction portion 63, having telescopically slidable multi-stage arm pieces 62 ($\mathbf{62}_1$ to $\mathbf{62}_7$) and the arm piece $\mathbf{62}_1$ on a base end of which being fixed to the device main body portion 61 and a claw portion 64 detachably attached to the arm piece $\mathbf{62}_7$ on a distal end of the extension/contraction portion 63 by a joint member such as a hinge 64*a*. Note that, the claw portion 64 is provided for catching and drawing the prize G, and the claw portions 64 of various shapes can be prepared according to types of the prizes G. In this example, the claw portion 64 of a bucket shape is attached.

Figure 2A:
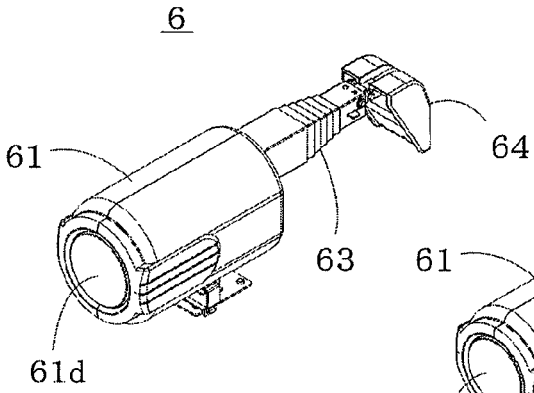
FIG. 2 are explanatory views each showing a structure of an arm member.
Figure 2B:
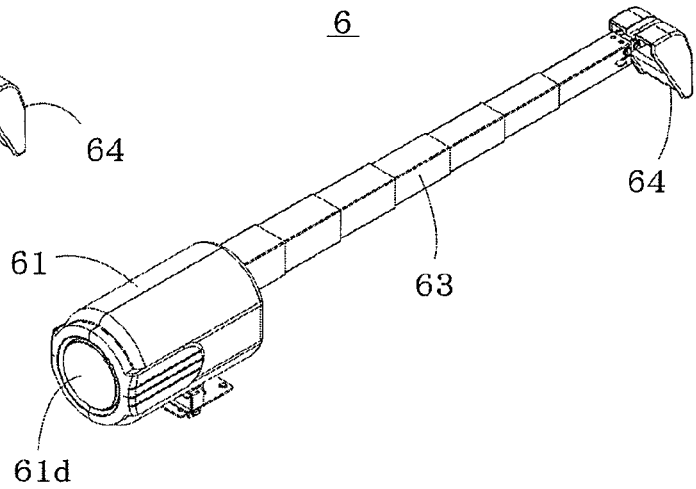
Figure 2C:
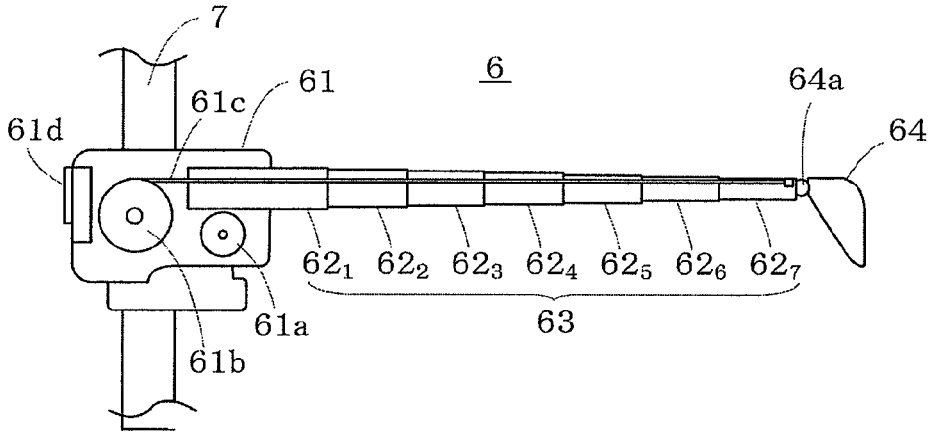

In the device main body portion 61, as shown in FIG. 2C, a reel 61*b* driven by an extension/contraction driving motor 61*a* and an elongated driving member 61*c* having one end wound around the reel 61*b* and another end attached to the arm piece $\mathbf{62}_7$ at the distal end and passing through an inside of the extension/contraction portion 63 are accommodated. By rotating the extension/contraction driving motor 61*a* in a forward direction or a backward direction, taking up or putting out of the driving member 61*c* is performed to draw in or push out the arm piece $\mathbf{62}_7$ on the distal end, thereby making it possible to allow the extension/contraction portion 63 to contract as shown in FIG. 2A or to extend as shown in FIG. 2B. For the driving member 61*c*, there may be used an elongated metal plate spring or the like having resistance against fatigue due to the repetitive taking in to the reel 61*b* and against a bending force at the time of pushing out of the arm piece $\mathbf{62}_7$. In order to prevent breakdown of the arm member 6, the apparatus main body portion 61 may include a limiter unit for limiting extension/contraction of the extension/contraction portion 63. With this structure, in a case where a load of a certain level or higher is applied to the extension/contraction driving motor 61*a*, driving of the extension/contraction driving motor 61*a* can be stopped.

The device main body portion 61 further includes a display window 61*d* indicating a remaining time in which the moving operation of the arm member 6 can be performed by a moving lever 11*a*.

Figure 2D:
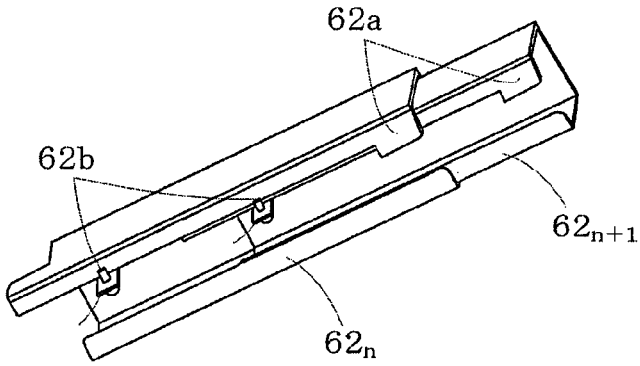

FIG. 2D is an enlarged explanatory view viewed from below and showing a structure of the two successive arm pieces $\mathbf{62}_n$ and $\mathbf{62}_{n+1}$ of the seven arm pieces $\mathbf{62}_1$ to $\mathbf{62}_7$ included in the extension/contraction portion 63.

As shown in FIG. 2D, each of the arm pieces 62 has a rectangular cross section, provided with a cavity capable of accommodating the arm piece 62 of the next stage by coming into slide contact with an outer periphery thereof, and an outer periphery which comes into slide contact with a cavity of the arm piece 62 of the previous stage, thereby enabling accommodation thereinto. A distal end side of each of the arm pieces 62 is provided with a lock piece 62*a* and a base end side thereof is provided with a lock pin 62*b*.

When the arm member 6 extends, sliding between the arm pieces $\mathbf{62}_n$ and $\mathbf{62}_{n+1}$ stops in a position where the lock pin 62*b* of the arm piece $\mathbf{62}_{n+1}$ of the next stage abuts on the lock piece 62*a* of the arm piece $\mathbf{62}_n$ on the base end side, so falling off of the arm pieces 62 can be prevented.

When the arm member 6 contracts, the sliding between the arm pieces $\mathbf{62}_n$ and $\mathbf{62}_{n+1}$ stops in a position where the lock pin 62*b* of the arm piece $\mathbf{62}_{n+1}$ of the next stage abuts on the lock pin 62*b* of the arm piece $\mathbf{62}_n$ on the previous stage, so an operation in which each of the arm pieces 62 slides into the arm piece 62 of the previous stage to be accommodated therein is performed regularly starting from the arm piece $\mathbf{62}_7$ on the distal end in an order of the arm piece $\mathbf{62}_6$, the arm piece $\mathbf{62}_5$ . . . , and so on, thereby ensuring a smooth extension/contraction operation of the arm member 6. In a case where the arm piece $\mathbf{62}_{n+1}$ on the distal end side slides into the arm piece which is closer to the base end side than the arm piece $\mathbf{62}_n$ of the immediately previous stage, backlash can be caused due to a difference in size of the arm pieces 62 on the outside and on the inside to cause the extension/contraction movement to be performed jerkily. However, with the arm pieces 62 shown in FIG. 2 as described above, the sliding is stopped in a position where the lock pins 62*b* engage with each other, so the above-mentioned inconvenience is prevented from occurring.

FIG. 3 is an explanatory view showing a structure of the vertical movement device 7 and the horizontal movement device 8 for driving the arm member 6 in the operation plane.

As shown in FIG. 3, the vertical movement device 7 has a guide rail member 71 for guiding the arm member 6 in a vertical direction Y in the game space R, a vertical driving motor 72 arranged on an upper end of the guide rail member 71, a main pulley 73 rotated by the vertical driving motor 72, a driven pulley 74 arranged on a lower end of the guide rail member 71, and a vertical belt 75 looped around both the main pulley 73 and the driven pulley 74. By rotating the vertical driving motor 72 in a forward or a backward direction, the arm member 6 attached to the vertical belt 75 at a connection point 76 is driven in the vertical direction.

Further, the horizontal movement device 8 is fixed to an upper surface and a lower surface in the game space R and includes an upper guide rail member 81 and a lower guide rail member 82 for guiding the vertical movement device 7 in a horizontal direction X in the game space R, a horizontal driving motor 83 arranged on one end of the upper guide rail member 81, a main pulley 84 rotated by the horizontal driving motor 83, a driven pulley 85 arranged on another end of the upper guide rail member 81, a horizontal belt 86 looped around both the main pulley 84 and the driven pulley 85, and a travel plate 87 traveling on the lower guide rail member 82. The guide rail member 71 has an upper end attached to the horizontal belt 86 at a connection point 88 and has a lower end attached to the travel plate 87. Accordingly, by rotating the horizontal driving motor 83 in the forward or the backward direction, the vertical movement device 7 is driven in the horizontal direction by being drawn by the horizontal belt 86.

By combining driving by the vertical movement device 7 and driving by the horizontal movement device 8, the arm member 6 can be moved to an arbitrary position in the operation plane (XY plane).

FIG. 4 is an explanatory view showing an exemplary appearance of the setting panel 16 mounted inside the accommodation door 15 of the game machine main body portion 2.

As shown in FIG. 4, the setting panel 16 is divided into a setting region for 1P (i.e., for the arm member 6 on the left hand side) and a setting region for 2P (i.e., for the arm member 6 on the right hand side). Each of those setting regions is provided with an arrival position setting knob 16*a* for setting an arrival position Z1 at a time of an extension operation of the arm member 6, a lowering distance setting knob 16*b* for setting a lowering distance Y1 at a time of a lowering operation of the arm member 6, and a returning position setting knob 16*c* for setting a returning position Z0 at the time of the contraction operation of the arm member 6.

Specifically, in the setting panel 16, variable resistors for the arrival position setting knob 16*a*, the lowering distance setting knob 16*b*, and the returning position setting knob 16*c* are built in. Stepless voltages, for example, in a range of 0 to 5 V generated when a resistance value of the corresponding variable resistor is changed by operating the arrival position setting knob 16*a*, the lowering distance setting knob 16*b*, and the returning position setting knob 16*c* are converted by an AD converter to obtain digital values and the obtained digital values are set to the arrival position Z1, the lowering distance Y1, and the returning position Z0.

More specifically, a digital value in a range of "30 to 70" is set to the arrival position Z1, a digital value in a range of "0 to 15" is set to the returning position Z0 and a digital value in a range of "0 to 99" is set to the lowering distance Y1. In order to prevent malfunction due to an error of the variable resistor, a predetermined lower limit value is set for each of the set values when the voltage value is equal to or lower than a predetermined value (for example, 0.5 V) and a predetermined upper limit value is set for each of the set values when the voltage value is equal to or higher than a predetermined value (for example, 4.5 V).

Figure 5A:
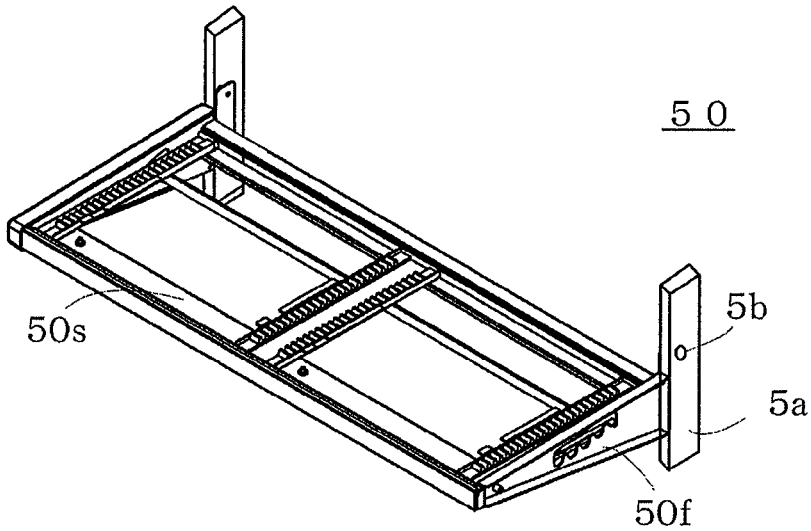
FIG. 5 are explanatory views showing a structure of a shelf member.
Figure 5B:
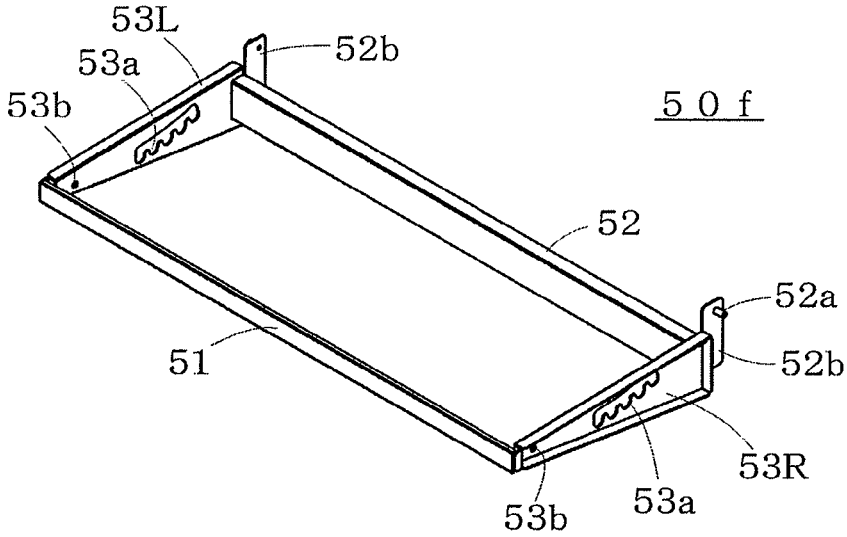
Figure 5C:
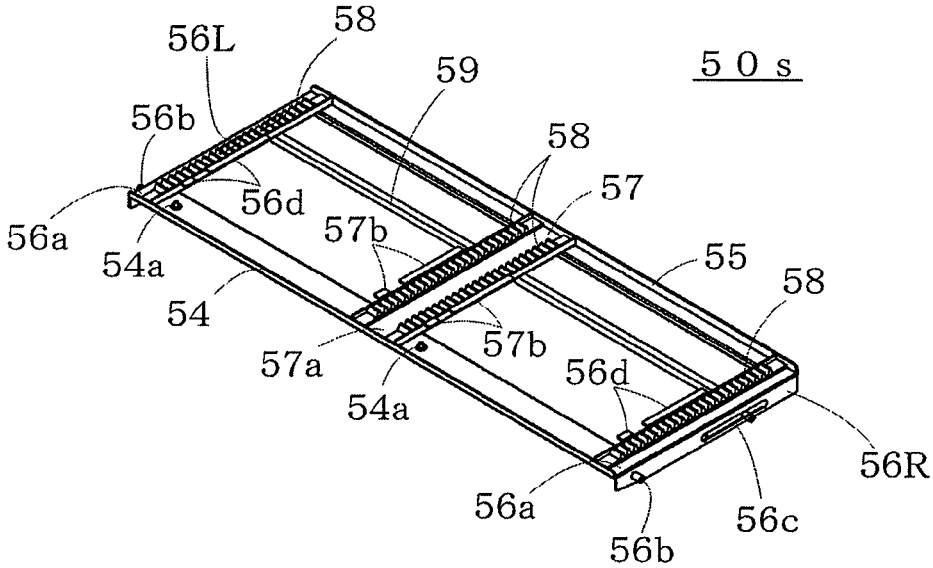

FIG. 5A is an explanatory view showing a structure of a shelf member 50 constituting the multi-stage shelf portion 5. FIGS. 5B and 5C are exploded perspective views of a framework portion 50*f* and a support member 50*s* constituting the shelf member 50.

As illustrated in FIG. 5, the framework portion 50*f* is a substantially rectangular frame member including a front plate 51, a back plate 52, and side plates 53L and 53R on the left and right. Each of left and right ends of the back plate 52 is provided with a mounting plate 52*b* having a mounting pin 52*a* projecting upright. Further, in the vicinity of substantially a center of each of the side plates 53L and 53R, there is formed a receiving groove 53*a* having a plurality of stages increasing in arrangement height successively from a front to a back. In a front end of each of the side plates 53L and 53R, there is formed a shaft insertion hole 53*b*.

On the other hand, the support member 50*s* includes a front plate 54, a back plate 55, side plates 56L and 56R on the left and right, and a middle plate 57 extending from the front plate 54 to the back plate 55 at substantially a midpoint between both side plates 56L and 56R. The support member 50*s* is a rectangular member having such a size that allows accommodation in the framework portion 50*f*.

Upper surfaces of the side plates 56L and 56R and the middle plate 57 are support surfaces 56*a* and 57*a*, respectively, having evenness allowing leg portions 44 of the prize placing base 4 described later to smoothly roll thereon. Four racks 58 on which a plurality of convexes and concaves are arranged in a fore-and-aft direction are mounted on the support surfaces 56*a* and 57*a*.

Further, a front end of each of the side plates 56L and 56R has a rotation shaft 56*b* protruding therefrom to be rotatably supported by the shaft insertion hole 53*b* of the framework portion 50*f*. In the vicinity of a center of each of the side plates 56L and 56R, there is formed a slide hole 56*c* extending in a fore-and-aft direction. In the slide holes 56*c*, a slide pin 59 capable of being slid in the fore-and-aft direction along the slide holes 56*c* is inserted.

Figure 6A:
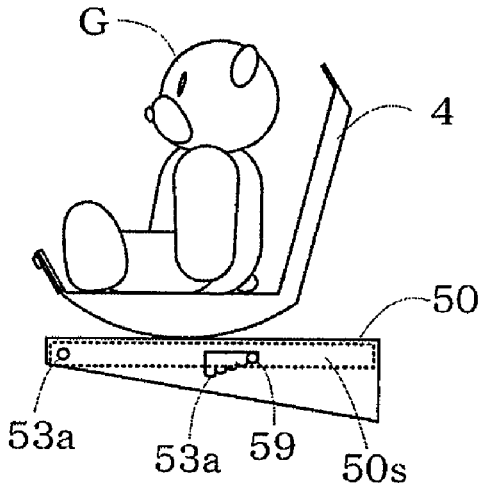
FIG. 6 are explanatory views showing modes of adjustment of an inclination angle of a support member by a first inclination angle adjusting mechanism.
Figure 6B:
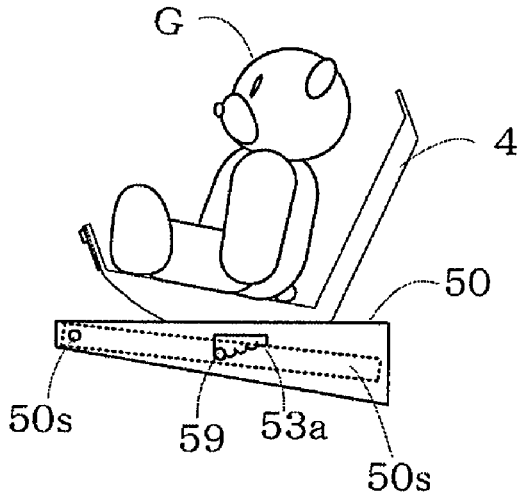

Here, the shaft insertion holes 53*b*, the rotation shaft 56*b*, the receiving groove 53*a*, and the slide pin 59 constitute a second inclination angle adjusting mechanism for adjusting an inclination angle of the support member 50*s* in the fore-and-aft direction with respect to a horizontal plane. That is, the rotation shafts 56*b* are axially supported by the shaft insertion holes 53*b* so as to be rotatable at the front ends of the side plates 56L and 56R and the slide pin 59 is supported by one of the plurality of stages of each of the receiving grooves 53*a*. Thus, the support member 50*s* is mounted to the framework portion 50*f* such that the inclination angle of the support member 50*s* in the fore-and-aft direction is adjustable. Accordingly, when the slide pin 59 is supported by the most rearward stages of the receiving grooves 53*a*, as shown in FIG. 6A, a support surface of the support member 50*s* can be made substantially horizontal. By supporting the slide pin 59 by more forward stages of the receiving grooves 53*a* as shown in FIG. 6B, the backward inclination angle of the support surface of the support member 50*s* can be made larger.

Further, to positions of the front plate 54 of the support member 50*s* in the vicinity of the left side plate 56L and in the vicinity of the middle plate 57, screw nuts 54*a* are mounted. On each of a left side of the right side plate 56R and a right side of the left side plate 56L, there is provided a pair of engagement protrusions 56*d*. On each side of the middle plate 57, there is provided a pair of engagement protrusions 57*b*.

Mounting and fixation of the shelf member 50 is performed by inserting the mounting pins 52*a* of the framework portion 50*f* into the mounting holes 5*b* drilled in support columns 5*a* provided upright in a vertical direction in predetermined positions of the game space R. Each of the support columns 5*a* can be formed with a plurality of mounting holes 5*b* in positions different in height. As a result, a plurality of shelf members 50 can be arranged in a height direction, or a mounting height of each of the shelf members 50 can be adjusted according to a size of the prize G to be used.

Figure 7A:
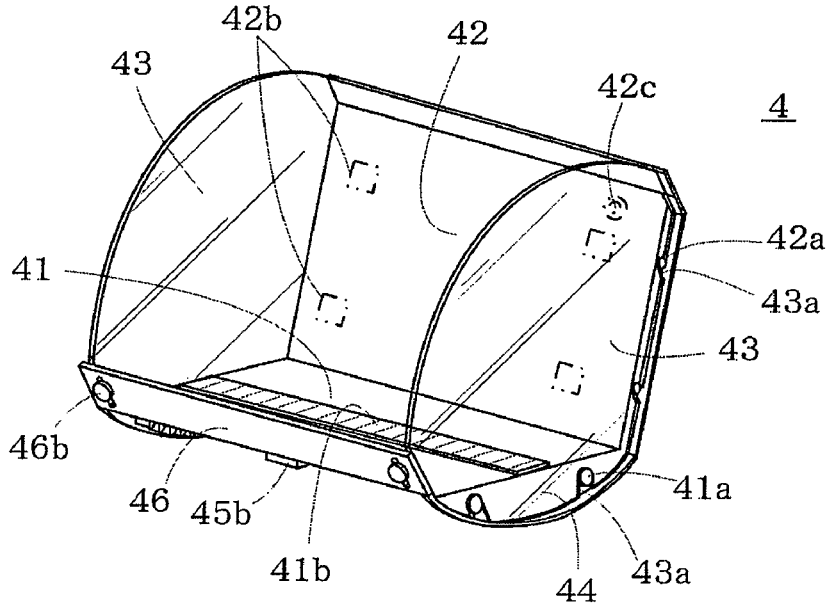
FIG. 7 are explanatory views showing a structure of a prize placing base according to an embodiment of the present invention.
Figure 7B:
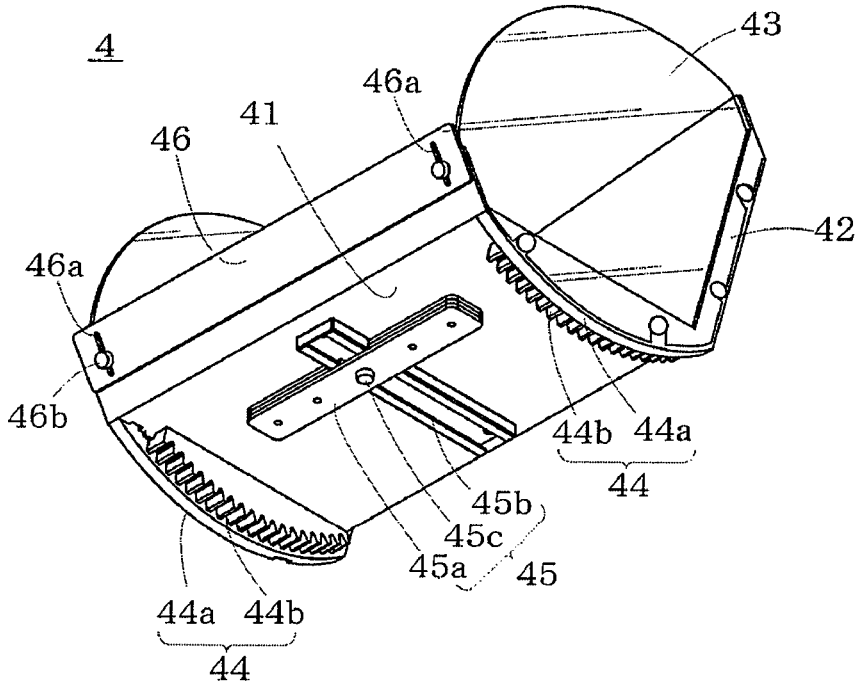

FIG. 7 are explanatory views showing a structure of the prize placing base 4 supported on the shelf member 50. FIGS. 7A and 7B show perspective views viewed from above and below sides of the prize placing base 4.

As illustrated in FIG. 7, the prize placing base 4 has a first placing plate 41 having a rectangular shape and a second placing plate 42 having a rectangular shape and raising from a back end of the first placing plate 41 at a predetermined angle. The prize placing base 4 has a cage shape with openings at front and top sides thereof and has side plates 43 detachably attached by fitting, in fitting holes 43*a*, fitting protrusions 41*a* and 42*a* laterally protruding from the first placing plate 41 and the second placing plate 42, respectively.

The prize placing base 4 can be made of any material such as an acrylic board. However, in order to ensure visibility of the prize G from a lateral direction, the side plate 43 is preferably made of a transparent material.

The first placing plate 41 has an upper surface side used as a first placing surface on which the prize G is placed. On the first placing surface, there can be placed a slip inhibition member 41*b* made of rubber or the like for inhibiting slippage of the prize G on the placing surface, depending on kinds of the prize G to be used.

A lower side of the first placing plate 41 is provided with the two leg portions 44 protruding therefrom each having a contact surface 44*a* curved in a convex shape or an arcuate shape and a gear 44*b* comprising a plurality of convexes and concaves arranged at predetermined intervals along the curve of the contact surface 44*a*. In this case, a width dimension of the contact surfaces 44*a* is a dimension allowing placing on the support surfaces 56*a* and 57*a* of the support member 50*s*. The distance between the leg portions 44 is the same dimension as the distance from the support surface 56*a* on the right side or the left side to the support surface 57*a*. Thus, two prize placing bases 4 can be arranged on each of the shelf member 50. Further, the convexes and concaves of the gear 44*b* are formed in sizes and at intervals allowing meshing with the concaves and convexes of the rack 58 when the prize placing base 4 is placed on the support member 50*s* and the contact surfaces 44*a* are brought into contact with the support surfaces 56*a* and 57*a*.

On a back surface of the first placing plate 41, there is further provided a first inclination angle adjusting mechanism 45 including a weight plate 45*a*, a rail 45*b* extending in a fore-and-aft direction for sliding the weight plate 45*a*, and a fixing screw 45*c* for fixing the weight plate 45*a* to the rail 45*b* to stop sliding of the weight plate 45*a* thereon. Further, a fall-off blocking member 46 whose height can be adjusted is mounted to a front end of the first placing plate 41 by screw fixation using long holes 46*a* and screws 46*b*.

The second placing plate 42 has a front surface side used as a second placing surface on which the prize G is placed. On a back surface of the second placing plate 42, there are provided four engagement protrusions 42*b* to be engaged with the engagement protrusions 56*d* and 57*b* protruding from the side plates 56L and 56R and the middle plate 57 of the support member 50*s*, and a screw hole 42*c* in which the screw nut 54*a* mounted to the front plate 54 of the support member 50*s* is to be screwed.

FIG. 8 are explanatory views showing placing modes of the various prizes G, each of which can be realized by using the prize placing base 4.

Figure 8A:
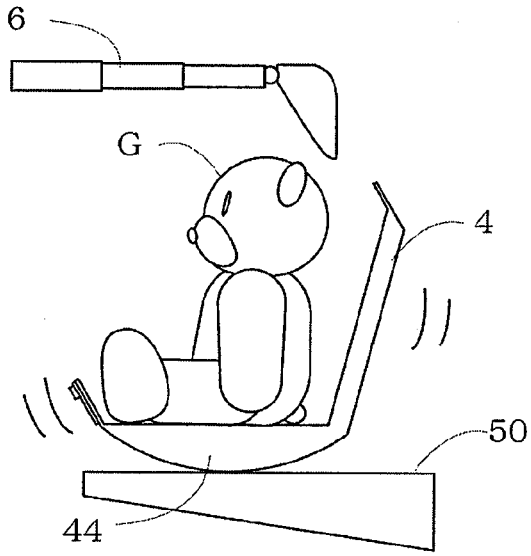
FIG. 8 are explanatory views showing modes of placement of the prize using the prize placing base.

FIG. 8A shows a case where the prize G is placed on the placing surface of the first placing plate 41. In this case, the prize placing base 4 is mounted while bringing the contact surfaces 44*a* each having the arcuate shape into contact with the support surfaces 56*a* and 57*a* of the support member 50*s*. Accordingly, even when the arm member 6 is just brought into contact with the prize G lightly, the prize placing base 4 rocks in the fore-and-aft direction along the curve of the contact surfaces 44*a* and the prize G on the first placing plate 41 rocks together therewith. Therefore, when the arm member 6 is brought into contact with the prize G, even if acquisition of the prize G fails, the prize G rocks largely. Accordingly, it is possible to give a player a sense that acquisition of the prize G has been almost achieved.

Further, the rocking of the prize placing base 4 is performed in a state where the gears 44*b* of the leg portions 44 engage with the racks 58 on the support member 50*s*. Accordingly, even when the arm member 6 is brought into contact with the prize G or the prize placing base 4, a rocking position of the prize placing base 4 is prevented from being easily shifted. That is, the difficulty level of the prize acquisition intended by an installer of the machine is prevented from being changed by a forward or backward shift of an installation position of the prize placing base 4 or a change of an orientation of the prize placing base 4 while the games are repeated.

Figure 8B:
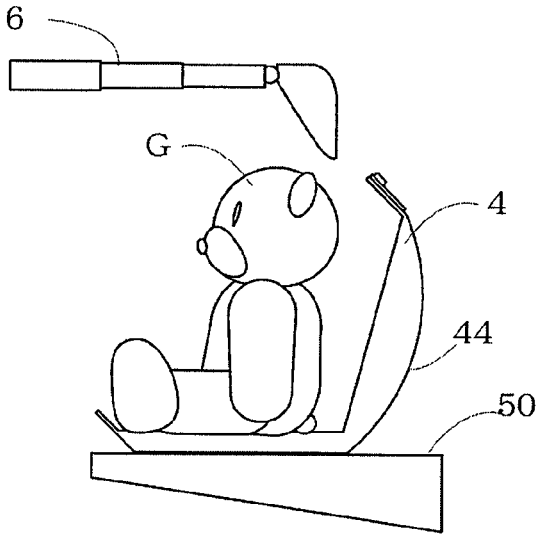

FIG. 8B shows a case where the prize G is placed on the placing surface of the second placing plate 42. In this case, even when the arm member 6 is brought into contact with the prize G or the prize placing base 4, the rocking of the prize placing base 4 is not caused, so the prize G can be placed in a stable manner. Therefore, the prize G which is preferably kept in a standing state such as a confectionery packed in a box, the prize G which is hardly expected to obtain a working effect by rocking the prize G, or the like can be placed on the prize placing base 4 in an installation mode of the FIG. 8B. Further, the prize placing plate 4 can be immovably mounted to the shelf member 50 by engaging the engagement protrusions 42*b* with the engagement protrusions 56*d* and 57*b* and by screwing the screw nut 54*a* into the screw hole 42*c*. As a result, when the arm member 6 is brought into contact with the prize G or the prize placing base 4, the prize placing base 4 is prevented from sliding and moving on the shelf member 50 and from being lifted therefrom. Therefore, it is possible to prevent a display mode of the prize G from being unsightly and to prevent the difficulty level of the prize acquisition from changing for each game, for example.

Figure 8C:
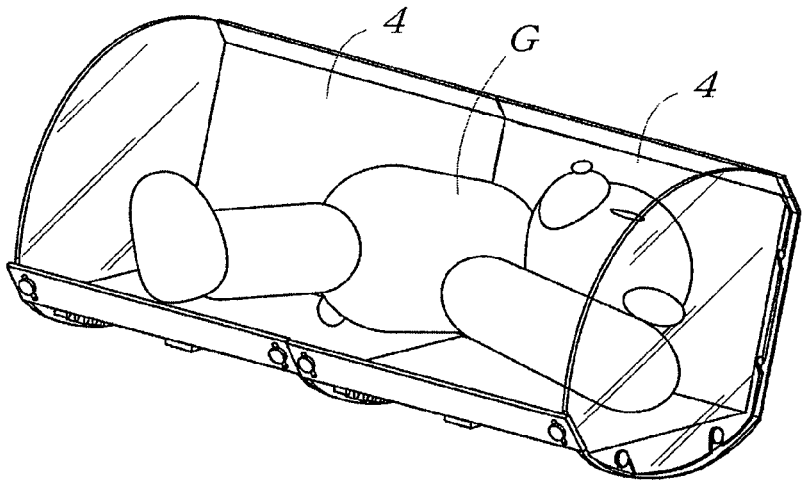

FIG. 8C shows a placing mode of the prize G, which is enabled when two of the prize placing bases 4 are used to be placed side by side. As shown in FIG. 8C, by aligning two of the prize placing bases 4 side by side with the left side plate 43 of the prize placing base 4 arranged on a right side and the right side plate 43 of the prize placing base 4 arranged on a left side being removed, it is possible to place a prize G having a large width which cannot be placed on the single prize placing base 4. Although two of the prize placing bases 4 are aligned in this example, by employing structures in which three or more prize placing bases 4 are aligned, the prizes G of various sizes can be placed. Likewise, FIG. 8C shows the case where the prize G is placed on the placing surfaces of the first placing plates 41. However, even in a case where the prize G is placed on the placing surfaces of the second placing plates 42, a large prize G can be placed by aligning a plurality of the prize placing bases 4 in a similar manner to the above.

FIG. 9 are explanatory views each showing a mode in which the inclination angle of the prize placing base 4 in the fore-and-aft direction in an initial state is adjusted by the first inclination angle adjusting mechanism 45.

FIG. 9A shows a case where the weight plate 45*a* is slid and fixed to a rear side of the rail 45*b*. In this case, the prize placing base 4 is inclined backwardly in the initial state (state where an external force by the arm member 6 or the like is not applied). As shown in FIG. 9B, when the weight plate 45*a* is slid to a front side of the rail 45*b*, the prize placing base 4 is inclined forwardly in the initial state. The more the prize placing base 4 is inclined backwardly in the initial state, the more difficult the acquisition of the prize G becomes. The more the prize placing base 4 is inclined forwardly in the initial state, the easier the acquisition of the prize G becomes. Accordingly, it is possible to adjust the difficulty level of the prize acquisition according to a fixing position of the weight plate 45*a*.

FIG. 10 are explanatory views each showing a mode in which a difficulty level of the prize acquisition is adjusted by a height adjustment of the fall-off blocking member 46. FIG. 10A shows a case where the fall-off blocking member 46 is attached such that an extension height from the first placing plate 41 is small. FIG. 10B shows a case where the fall-off blocking member 46 is attached such that the extension height from the first placing plate 41 is large.

As shown in FIG. 10A, in a case where the extension height of the fall-off blocking member 46 is small, when the prize G is drawn to the front by the contraction operation of the arm member 6, the prize G easily rides over the fall-off blocking member 46 to fall off. However, as shown in FIG. 10B, in a case where the extension height of the fall-off blocking member 46 is made larger, the prize G is difficult to ride over the fall-off blocking member 46 and easily returns to an original position.

By combining adjustments of inclination angle of the support member 50*s* (by the first inclination angle adjusting mechanism 45), the inclination angle of the prize placing base 4 in the initial state (by the second inclination angle adjusting mechanism), and the extension height of the fall-off blocking member 46, a setting of the difficulty level of the prize acquisition in various manners can be realized.

Figure 11:
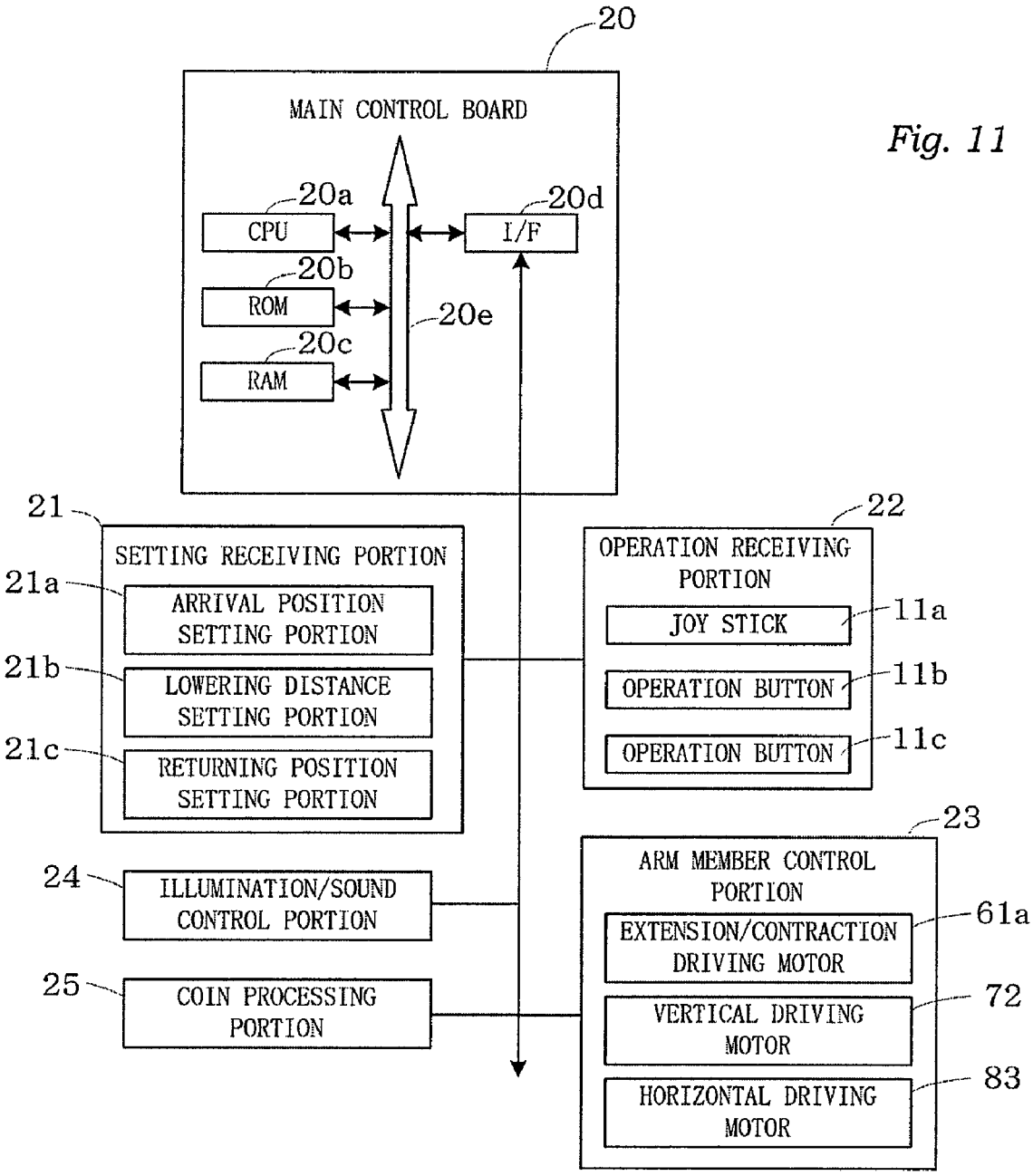
FIG. 11 is an explanatory diagram showing a system structure of the prize acquisition game machine according to the embodiment of the present invention.

FIG. 11 is an explanatory diagram showing a system structure of the prize acquisition game machine 1.

As shown in FIG. 11, in this embodiment, to the main control board 20, a setting receiving portion 21, an operation receiving portion 22, an arm member control portion 23, an illumination/sound control portion 24, a coin processing portion 25, and the like are electrically connected through an I/F 20*d* and a signal line.

In this case, the main control board 20 is a portion for controlling entire the prize acquisition game machine 1. The main control board 20 includes a CPU 20*a*, a ROM 20*b* in which various programs and data for controlling peripheral equipment are stored, a RAM 20*c* for temporarily storing operation data for computation, the I/F 20*d* for transmitting and receiving various signals to and from the CPU 20*a* and the peripheral equipment, and a bus 20*e* for interconnecting those components with one another.

The setting receiving portion 21 is an interface for transmitting each set value set on the setting panel 16 to the main control board 20. The setting receiving portion 21 includes an arrival position setting portion 21*a*, a lowering distance setting portion 21*b*, and a returning position setting portion 21*c*. That is, the arrival position setting portion 21*a* derives a digital value in a range of "30 to 70" obtained through the operation of the arrival position setting knob 16*a* as the arrival position Z1, the lowering distance setting portion 21*b* derives a digital value in a range of "0 to 99" obtained through the operation of the lowering distance setting knob 16*b* as the lowering distance Y1, the returning position setting portion 21*c* derives a digital value in a range of "0 to 15" obtained through an operation of the returning position setting knob 16*c* as the returning position Z0, and the setting receiving portion 21 transmits those values to the main control board 20 as needed.

The operation receiving portion 22 is an interface for transmitting signals from the various operation members 11*a* to 11*c* of the operation panel 11 to the main control board 20. When an operation of the moving lever 11*a* is detected, a signal instructing the arm member to be driven in the vertical or horizontal direction according to a direction of the operation is transmitted to the main control board 20. When an operation of an extension button 11*b* or a stop button 11*c* is detected, a signal instructing to start or stop the extension of the arm member 6 is transmitted to the main control board 20.

The arm member control portion 23 performs control of the arm member 6 in response to a control signal from the main control board 20. That is, when the signal instructing the extension/contraction operation of the arm member 6 is received from the main control board 20, the arm member control portion 23 performs driving control of the extension/contraction driving motor 61*a*, thereby causing the arm member 6 to perform the extension/contraction operation. Further, when a signal instructing a movement of the arm member 6 in the operation plane is received from the main control board 20, the arm member control portion 23 performs a process of moving the arm member 6 in the operation plane by performing driving control of the vertical driving motor 72 and the horizontal driving motor 83.

The coin processing portion 25 performs an identification processing for coins inserted in the coin slot 12. When insertion of valid coins corresponding to a predetermined amount is detected, the coin processing portion 25 performs a process of transmitting a coin detection signal to the main control board 20. In order to output rendering illumination and a sound effect corresponding to a progress of the game or the like in response to a control signal from the main control board 20, the illumination/sound control portion 24 performs control of the illumination device 10, the speaker 14, and the like.

Figure 12:
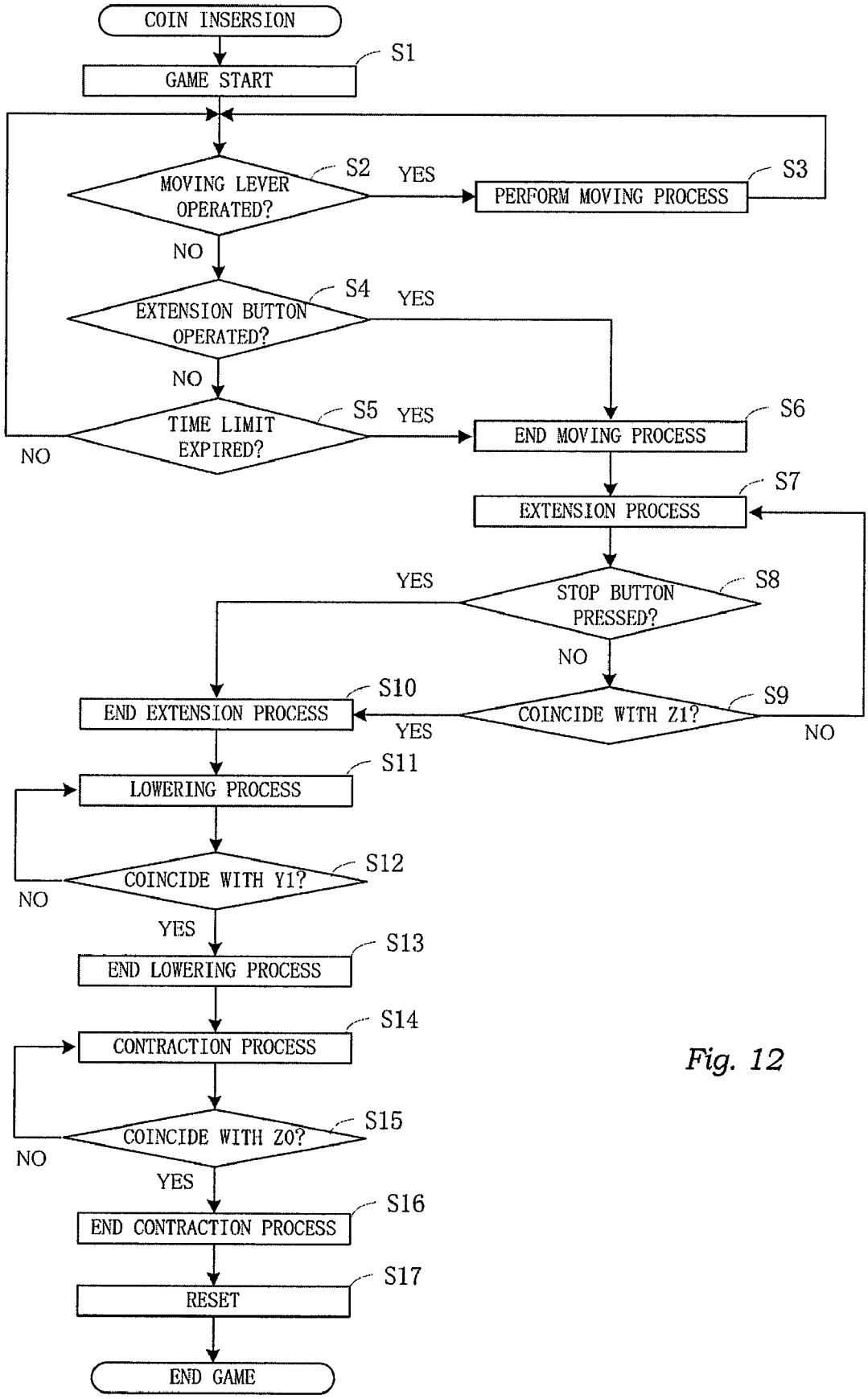
FIG. 12 is a flow chart showing processes performed in the prize acquisition game machine according to the embodiment of the present invention.

FIG. 12 is an explanatory view showing a flow of processes performed in the prize acquisition game machine 1.

The main control board 20 starts a game process on a condition that the coin detection signal of the coins of a predetermined amount is received from the coin processing portion 25 (Step S1). That is, the operations of the operation members 11*a* to 11*c* of the operation panel 11 are validated and a countdown of a time limit on the display window 61*d* of the arm member 6 is started. Note that, an initial setting is performed by the arm member control portion 23 such that, at a start of the game process, the arm member 6 is arranged in a stand-by position such as a lower left corner in the operation plane, and the distal end of the arm member 6 (mounting position of the claw portion 64) is in the returning position Z0 set by the returning position setting portion 21*c*. Further, from the start of the game process to an end of the game process, the main control board 20 monitors the operations of the operations members 11*a* to 11*c* and a lapse of time.

In Step S2, when the moving lever 11*a* is operated, according to the direction of the operation, the arm member control portion 23 drives the vertical drive motor 72 and the horizontal drive motor 83 to perform a process of moving the arm member 6 in the operation plane (Step S3).

In successive Steps S4 and S5, the operation to the extension button 11*b* and the expiry of the time limit are inspected. As long as the operation or the expiry is not determined, every time when the operation of the moving lever 11*a* is detected in Step S2, the movement process of the arm member 6 in Step S3 is repeated.

Figure 13A:
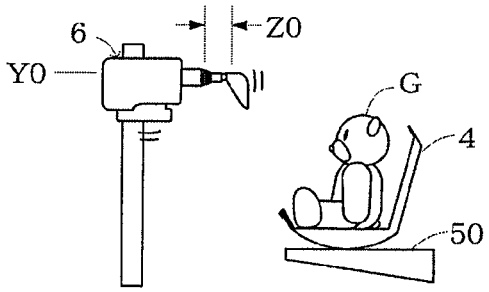
FIG. 13 are explanatory views showing modes of a prize acquisition game performed in the prize acquisition game machine according to the embodiment of the present invention.

On the other hand, when the operation to the extension button 11*b* is detected in Step S4 or the expiry of the time limit is detected in Step S5, the process advances to Step S6, and the moving process of the arm member 6 ends. FIG. 13A is an explanatory view showing the arm member 6 and the prize G placed on the prize placing base 4 in Step S6. As shown in FIG. 13A, the distal end position of the arm member 6 is maintained in the returning position Z0 which is the same as a position at the game start. In FIG. 13A, a height position of the arm member 6 in Step S6 indicated by a symbol Y0.

In Step S7, the arm member control portion 23 drives the extension/contraction driving motor 61*a* to perform an extension process for extending the arm member 6.

In Step S8, the operation of the stop button 11*c* is inspected. When the operation is not detected, inspection is further performed in Step S9 to determine whether or not the position of the distal end of the arm member 6 coincides with the arrival position Z1 set by the arrival position setting portion 21*a*. Until a result of the inspection in one of Steps S8 and S9 becomes "YES", the extension process in Step S7 is repeated.

Note that, the inspection in Step S9 is performed by detecting the amount of rotation of the extension/contraction driving motor 61*a* in Step S7 by an encoder (not shown) and comparing the amount with a difference (Z1−Z0) of the digital values set to the arrival position Z1 and the returning position Z0.

When the operation of the stop button 11*c* is detected in Step S8 or when the determination that the position of the distal end of the arm member 6 coincides with the arrival position Z1 is made in Step S9, the extension process of the arm member 6 is ended, and the process advances to Step S10. Therefore, when the operation of the stop button 11*c* is not performed, the extension process of the arm member 6 is ended at a position where the height position of the arm member 6 is maintained at Y0 and the position of the distal end of the arm member 6 coincides with the arrival position Z1, as shown in FIG. 13B.

In Step S11, the arm member control portion 23 drives the vertical driving motor 72 to perform a process of lowering the arm member 6. Further, in Step S12, an inspection is performed to determine whether or not a lowering distance of the arm member 6 in Step S11 coincides with the lowering distance Y1 set by the lowering distance setting portion 21*b*. In a case where a result of the inspection is "NO", the process of Step S11 is repeated.

The inspection in Step S11 is performed by comparing a driving time of the vertical driving motor 72 in Step S11 with a time value corresponding to the digital value set to the lowering distance Y1.

Figure 13E:
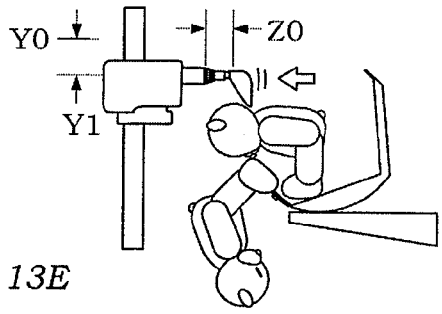
Figure 13B:
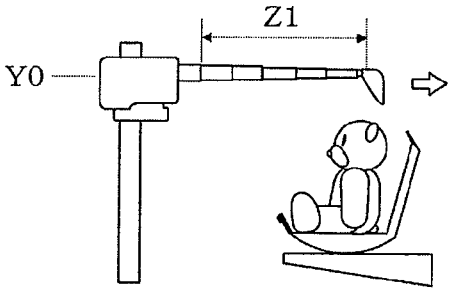
Figure 13F:
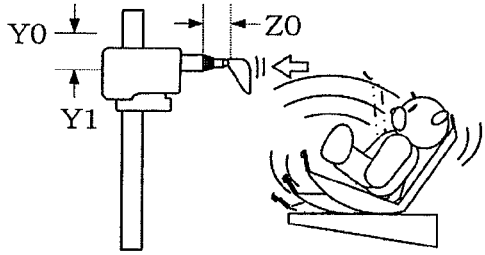
Figure 13C:
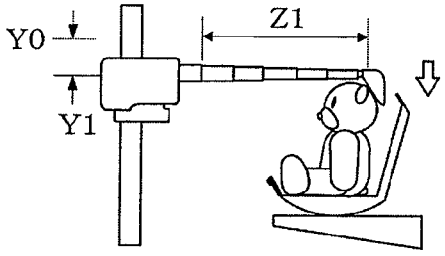

As shown in FIG. 13C, when the lowering distance of the arm member 6 coincides with the lowering distance Y1 set by the lowering distance setting portion 21*b*, the process advances from Step S12 to Step S13, and the lowering process of the arm member 6 is ended.

Figure 13D:
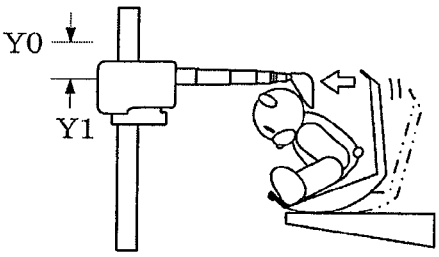

In Step S14, the arm member control portion 23 drives the extension/contraction driving motor 61*a* to perform a contraction process for contracting the arm member 6 (FIG. 13D). Further, in Step S15, an inspection is performed to determine whether or not the position of the distal end of the arm member 6 coincides with to the returning position Z0 set by the returning position setting portion 21*c*. When a result of the inspection is "NO", the contraction operation of the arm member 6 in Step S14 is repeated.

Note that the inspection in Step S15 is performed by detecting the amount of rotation of the extension/contraction driving motor 61*a* in Step S14 by the encoder (not shown) and comparing the amount with the difference (Z1−Z0) of the digital values set to the arrival position Z1 and the returning position Z0.

As shown in FIG. 13E or 13F, when the position of the distal end of the arm member 6 coincides with the returning position Z0, the process advances to Step S16, and the contraction operation of the arm member 6 is ended.

At this time, as shown in FIG. 13E, when the prize G rides over the fall-off blocking member 46 to fall off, the prize G is paid out from the prize pay-out opening 13 to be provided to the player. On the other hand, when the prize G cannot ride over the fall-off blocking member 46, as shown in FIG. 13F, the prize G returns to an original position. At this time, the prize G rocks largely in the fore-and-aft direction by the prize placing base 4. Accordingly, the player is given the sense that acquisition of the prize G has been nearly achieved, thereby making it possible to enhance interest of the players to play the game.

After Step S16, a reset process for returning the arm member 6 to the stand-by position is performed in Step S17, and the game process ends.

As described above, in the prize acquisition game machine 1 of the present invention, the prize placing base 4 is used in an operation mode in which the leg portions 44 are placed on the support surfaces 56*a* and 57*a*, thereby achieving an effect in which when the arm member 6 is brought into contact with the prize G, the prize G rocks largely or a probability of rocking the prize G can be increased.

Further, in the prize acquisition game machine 1 of the present invention, the difficulty level of the prize acquisition can be adjusted by the first inclination angle adjusting mechanism 45, the second inclination angle adjusting mechanism, the fall-off blocking member 46, or the like for each individual prize placing base 4 or shelf member 50 in a manner in which the player can recognize the adjustment. The arrival position Z1, the lowering distance Y1, and the returning position Z0 of the arm member 6 can also be set to adjust the difficulty level of the prize acquisition for each arm member 6.

Further, in the prize acquisition game machine 1 of the present invention, in addition to the above-mentioned effect, it is also possible to achieve an effect in which technical intervention in the game is alleviated to some degree and a player who has little confidence in a game skill can also be given interest to play.

FIGS. 14A to 14D are explanatory views each showing the prize placing base 4 and a movement of the prize G placed on the prize placing base 4 in a case where the height position Y0 of the arm member 6 in Step S6 is lower than the examples shown in FIG. 13. FIGS. 14E to 14H are explanatory views each showing a prize placing base and a movement of the prize G in a case where the prize placing base having no rocking mechanism is used in the same case.

Figure 14A:
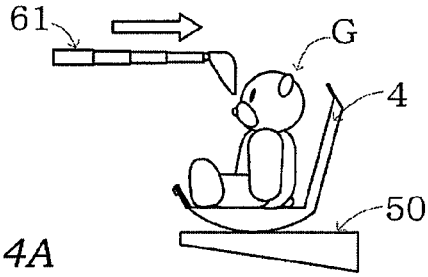
FIG. 14 are explanatory views showing modes of the prize acquisition game in a case where the prize placing base according to the embodiment of the present invention is used in comparison with a case where a prize placing base which does not have a structure of the present invention is used.
Figure 14E:
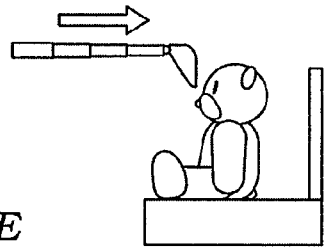
Figure 14B:
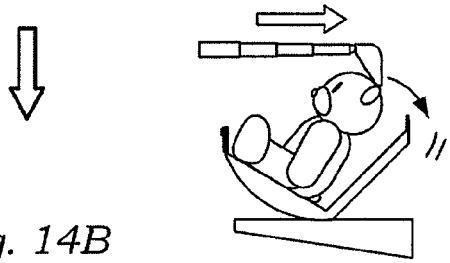
Figure 14F:
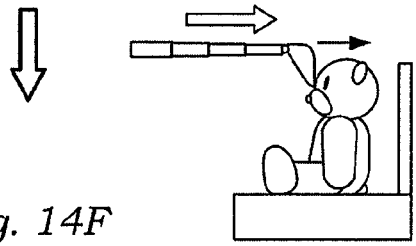
Figure 14C:
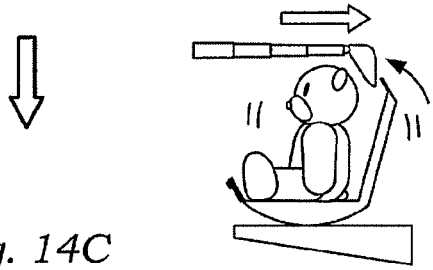
Figure 14G:
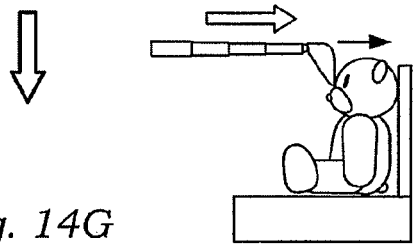
Figure 14D:
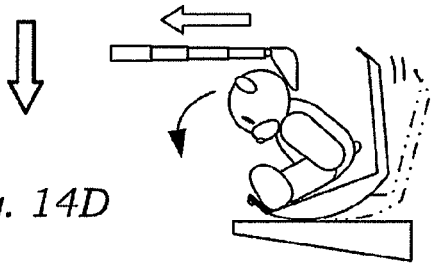

As shown in FIGS. 14A to 14D, in a case where the prize placing base 4 having the rocking mechanism is used, as the height position of the arm member 6 is too low, the claw portion 64 abuts against the prize G in the extension process (Step S7) of the arm member 6 (FIG. 14A). However, when the arm member 6 further extends, the prize G is inclined backwardly due to rocking of the prize placing base 4, thereby lowering the height of the prize G (FIG. 14B). After that, when the claw portion 64 passes the prize G, the prize G returns to the initial state (FIG. 14C). In this state, the lowering process of the arm member is performed (Step S11) and thereafter, the contraction process (Step S14) is performed. As a result, there is a possibility of acquiring the prize G (FIG. 14D).

Figure 14H:
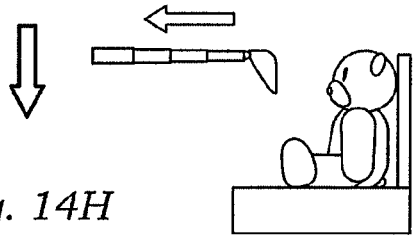

On the other hand, in a case where the prize placing base having no rocking mechanism is used, in a state where the claw portion 64 abuts on the prize G in the same manner as described above (FIG. 14E), even when the arm member 6 further extends, the arm member 6 simply pushes the prize G backwardly (FIGS. 14F and 14G). After that, even when the lowering process (Step S11) and the contraction process (Step S14) of the arm member are performed, there is no possibility of acquiring the prize G (FIG. 14H).

Alternatively, it is possible to provide a game according to such a mode different from the above mentioned embodiment. For example, by adjusting the returning position Z0 such that the arm member 6 can be brought into contact with the prize G or the prize placing base 4 in a state where the distal end of the arm member 6 is in the returning position Z0, the acquisition of the prize G is enabled by the movement of the arm member 6 in the operation plane.

In the above description, the present invention has been described based on the exemplary embodiment. However, the present invention is not limited by the above embodiments, and various changes and modifications can be made within a scope of claims.

For example, in the above mentioned embodiment, the description is made, as an example, of the prize acquisition game machine 1, in which each of the leg portions 44 of the prize placing base 4 is provided with a gear 44*b* on which convexes and concaves of the same sizes and shapes are arranged in the same intervals and racks 58 on which convexes and concaves of the same sizes and shapes are arranged in the same intervals are placed on the upper surface of the shelf members 50 and in the prize acquisition game machine 1, the prize placing base 4 can be placed at any position in the fore-and-aft direction on the shelf member 50. However, it is also possible to provide a placing position limiting means for limiting the position at which the prize placing base 4 can be placed on the shelf member 50.

Figure 15A:
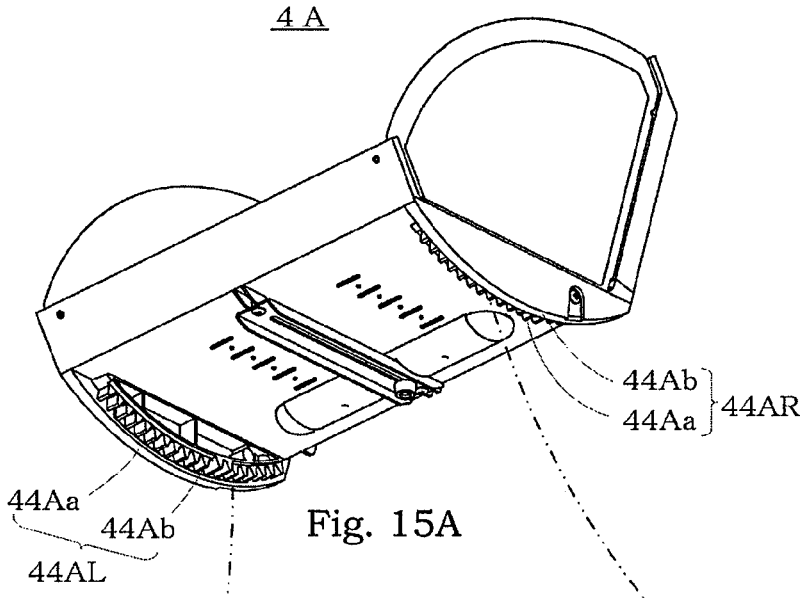
FIG. 15 are explanatory views each showing a structure of a prize placing base according to another embodiment of the present invention.
Figure 15B:
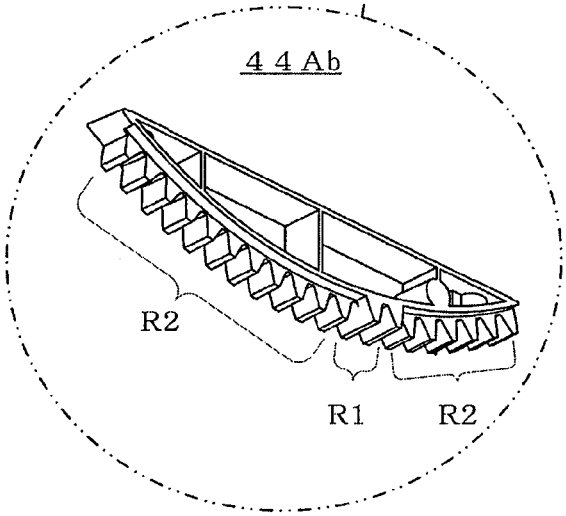
Figure 15C:
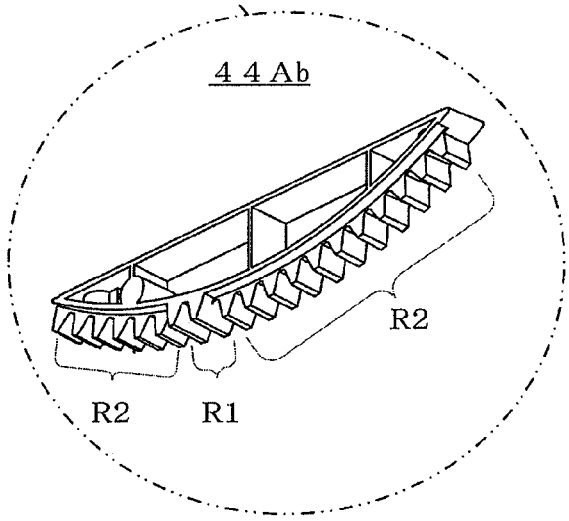
Figures 16A, 16B, 16C:
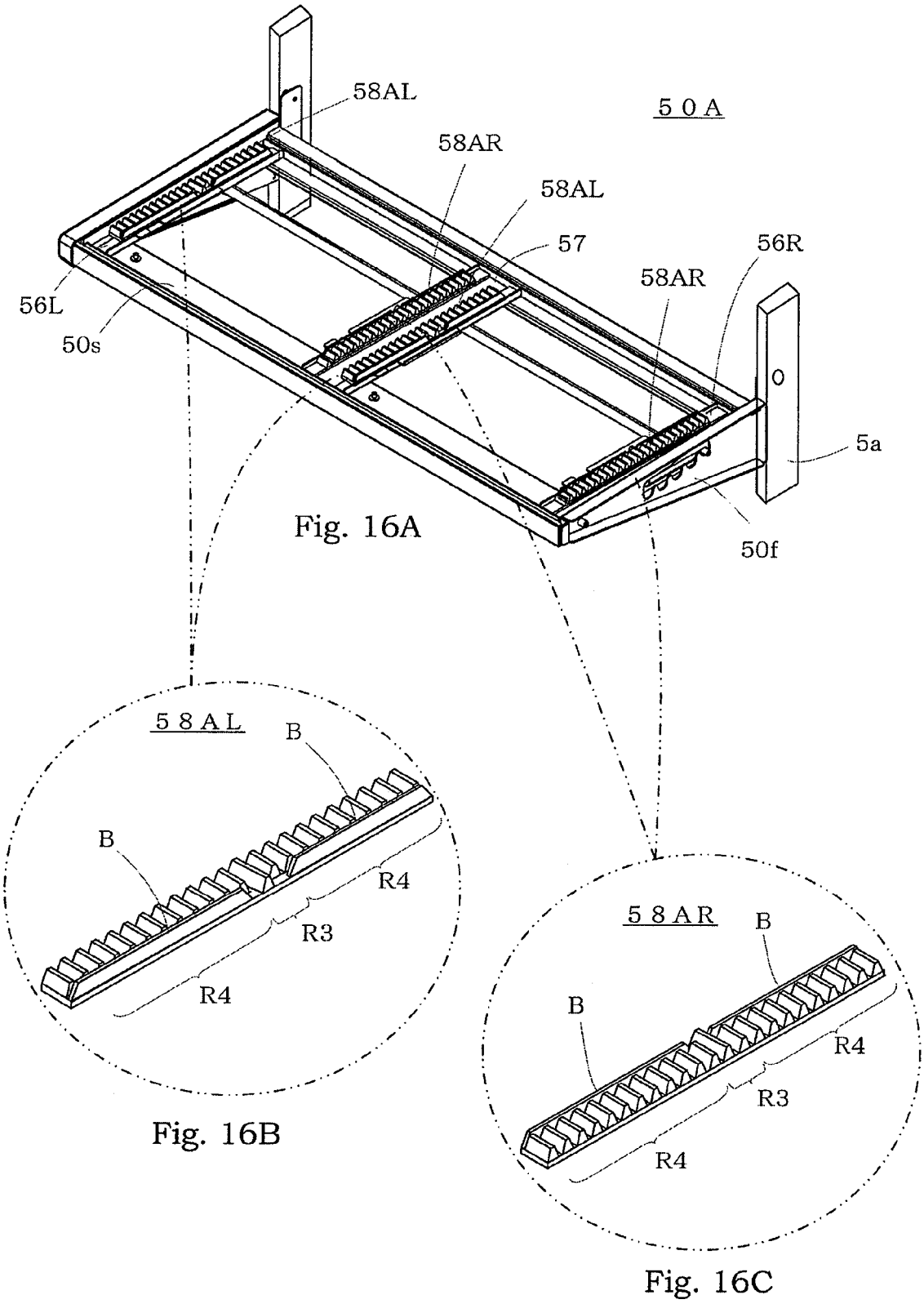
FIG. 16 are explanatory views each showing a structure of shelf member according to the another embodiment of the present invention.

FIGS. 15 and 16 show exemplary constitutions of a prize placing base 4A and a shelf member 50A provided with the placing position limiting means. A bottom side perspective view of the prize placing base 4A is shown in FIG. 15A and enlarged perspective views of gears 44Ab provided on left and right leg portions 44AL and 44AR of the prize placing base 4A are shown in FIGS. 15B and 15C, respectively. A perspective view showing entire constitution of the shelf member 50A is shown in FIG. 16A and enlarged perspective views of racks 58AL and 58AR placed on the upper surface of the shelf member 50A are shown in FIGS. 16B and 16C, respectively.

As shown in FIG. 15A, two leg portions 44AL and 44AR each having a contact surface 44Aa curved in a convex shape or an arcuate shape and a gear 44Ab with a plurality of convexes and concaves arranged at predetermined intervals along the curve of the contact surface 44Aa are provided on the bottom surface of the prize placing base 4A in the same way as in the prize placing base 4. As shown in FIGS. 15B and 15C, one or a plurality of (two in the example in the figure) convex(es) at a region (a first region) R1 on a rear side of the middle of the gear 44Ab of each of the leg portions 44AL and 44AR have larger width than the convexes in the other regions (second regions) R2.

On the other hand, as shown in FIG. 16A, four racks 58AL and 58AR are placed on the upper surface of the shelf member 50A in the same way as in the shelf member 50, and as shown in FIGS. 16B and 16C, barrier plates B each having a predetermined height (preferably the same height as or higher than the convexes of the racks 58AL and 58AR) are provided along the extending direction of the racks 58AL and 58AR at regions (fourth regions) R4 other than the generally center region (third region) R3 of the racks 58AL and 58AR. Herein, regarding the rack 58AR on the right side plate 58AR and the left side rack 58AR on a middle plate 57, the barrier plates B are provided at left side of the racks 58AR. Regarding the rack 58AL on the left side plate 58AL and the right side rack 58AL on the middle plate 57, the barrier plates B are provided at right side of the rack 58AL.

Figure 17A:
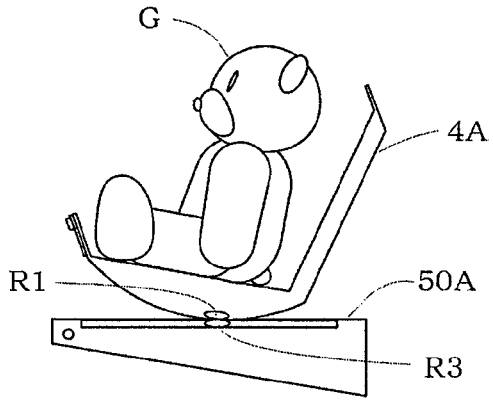
FIG. 17 are explanatory views each showing placing manners of the prize placing base on the shelf member according to the another embodiment of the present invention.
Figure 17B:
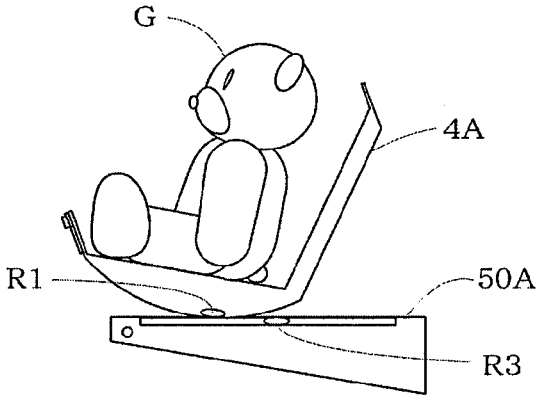
Figure 17C:
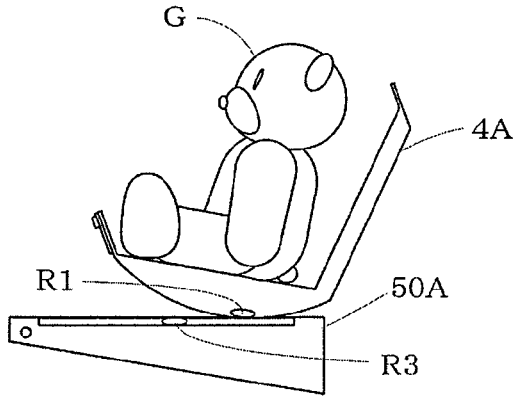

Therefore, when the prize placing base 40A is placed on the shelf member 50A with aligning the first regions R1 of the gears 44A with the third regions R3 of the racks 58AL and 58AR (see FIG. 17A), the prize placing base 4A is able to stably rock with engaging the gears 44Ab with the racks 58AL and 58AR. However, when the prize placing base 40A is placed on the shelf member 50A without aligning the first regions R1 of the gear 44A with the third regions R3 of the racks 58AL and 58AR (see FIG. 17B or 17C), it is not possible to engage the gears 44Ab with the racks 58AL and 58AR, because wide width convexes at the first regions R1 of the gears 44Ab abut the barrier plates B.

Thus, the convexes at the first regions R1 of the gears 44Ab of the prize placing base 4 and the barrier plates B on the shelf member 50A function as the placing position limiting means for limiting the placing position of the prize placing base 4A in the fore-and-aft direction on the shelf member 50A and it becomes possible to prevent problems, such as that the prize placing base 4A falls off from the shelf member 50A by the contact between the arm member 6 and the prize placing base 4A and the like, when the prize placing base 4A is placed at an excessively forward position (see FIG. 17B), from occurring.

Note that, although the description is made, as an example, of a case where the placing position limiting means is constituted by the convexes at the first regions R1 of the gears 44Ab and the barrier plates B in FIGS. 15 and 16, the same effect can be attained even in a case where a placing position limiting means in a different mode is provided. For example the same effect can be attained by setting the sizes, shapes and/or the intervals of the convexes and concaves of the gears 44Ab and racks 58AL, 58AR such that the convexes and concaves at the first regions R1 of the gears 44Ab are capable of engaging with the convexes and concaves at the third regions R3 of the racks 58AL and 58AR but are incapable of engaging with the convexes and concaves at the fourth regions R4 and the convexes and concaves at the second regions R2 of the gears 44AB are capable of engaging with the convexes and concaves at the fourth regions R4 of the racks 58AL and 58AR but are incapable of engaging with the convexes and concaves at the third regions R3.

Further, the racks 58AL and 58AR in which the widths of the convexes at the third regions R3 are larger than those of the convexes at the fourth regions R4 are shown in FIGS. 16A to 16C with an intention to obtain a fine engagement between the first regions R1 of the gears 44Ab and the third regions R3 of the racks 58AL and 58AR. However, it is also possible that the widths of the convexes at the third regions R3 are the same as those of the convexes at the fourth regions R4, as long as the problem of engagement is not caused.

Figure 18A:
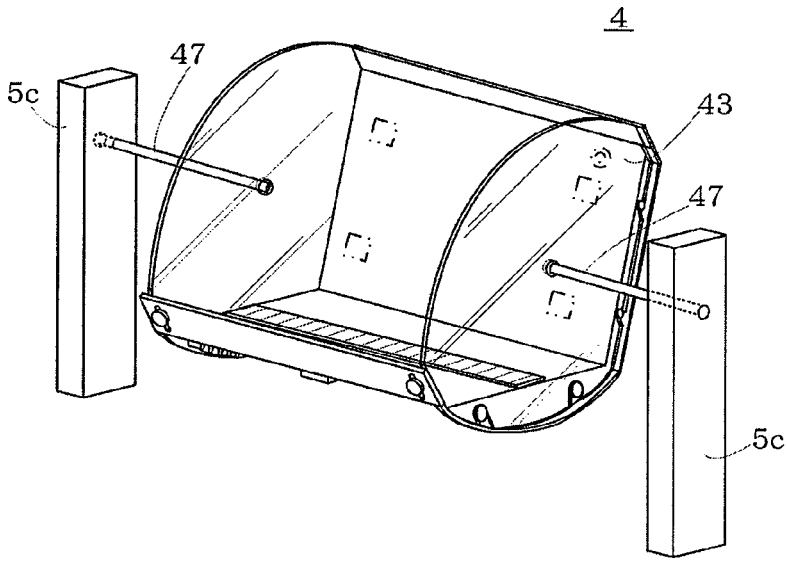
FIG. 18 are explanatory views each showing a structure of a prize placing base according to still another embodiment of the present invention.

Further, in the above embodiment, as a preferred mode of rocking the prize G, a description is made of a case where the prize placing base 4 having the leg portions 44 provided with the contact surfaces 44*a* is placed on the smooth support surfaces 56*a* and 57*a* so as to be capable of rolling thereon. However, as shown in FIG. 18A, in a case where horizontal shafts 47 inserted and fixed to the side plates 43 are rotatably supported by support members 5*c* vertically extending in the game space R, and the prize placing base 4 can rock by rotating about the horizontal shafts 47, the same effect as that of the above embodiment can be achieved.

Figure 18B:
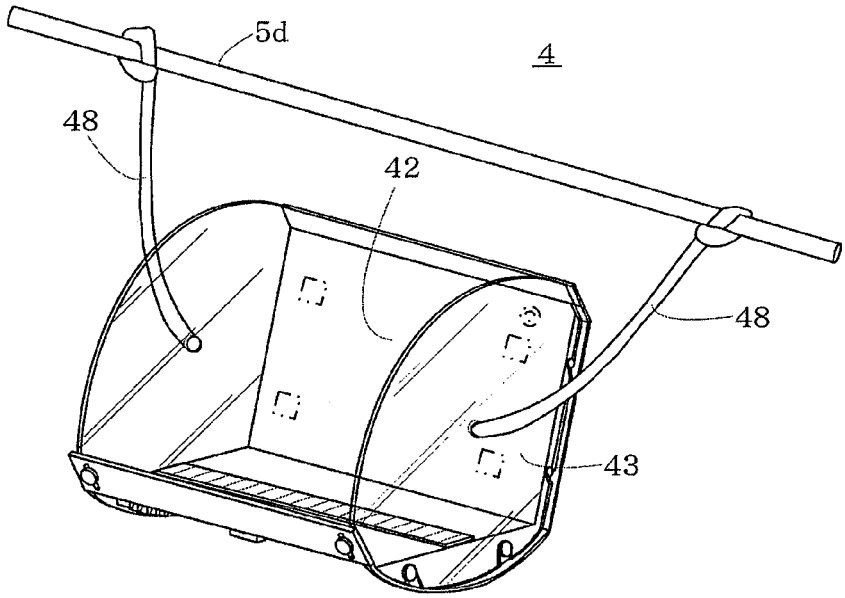

In the same manner, as shown in FIG. 18B, in a case where the prize placing base 4 is suspended by thread-like suspension members 48 each having one end fixed to a support member 5*d* horizontally extending across the game space R and another end fixed to the second placing plate 42 or the side plate 43 of the prize placing base 4, the prize placing base 4 can rock due to a pendular movement of the suspension members 48 and the same effect as that of the above embodiment can be obtained.

In the above embodiment, the description is made of the case where rocking of the prize placing base 4 is caused exclusively due to the contact between the arm member 6 and the prize G or the prize placing base 4. However, an additional driving unit for rocking the prize placing base 4 when a predetermined condition is satisfied (for example, in a case where the game process is not started for a certain time or more) can be provided to the prize placing base 4 or the shelf member 50. In this case, the prize is allowed to rock in a stand-by state, thereby making it possible to increase a customer attraction effect due to catching to the eye or to achieve an effect of giving change to game properties or the difficulty level of the prize acquisition by rocking the prize while the game process is in progress.

In the above embodiment, outer shapes and dimensions of the prize acquisition game machine 1 and the prize placing base 4, a process content of each operation in the machine, and the like are merely examples. Those may be arbitrarily modified within the scope of claims.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A prize acquisition game machine, comprising:

an arm member operated to move by a player;

a prize placing base having a placing surface on which a prize is placed, the prize falling off from the placing surface to be paid due to an extension/contraction operation in a fore-and-aft direction of the arm member out;

a support member for supporting the prize placing base; and a rocking mechanism provided between the prize placing base and the support member, for rocking the prize placing base in the fore-and-aft direction, wherein when the arm member is brought into contact with the prize placed on the prize placing base, due to a function of the rocking mechanism, the prize placing base rocks in the fore-and-aft direction.

2. A prize acquisition game machine according to claim 1, wherein:

the prize placing base has a leg portion provided with a contact surface curved in a convex shape;

the support member has a support surface for supporting the leg portion;

the rocking mechanism comprises the contact surface and the support surface; and the prize placing base rocks in the fore-and-aft direction by rolling with the contact surface being brought into contact with the support surface.

3. A prize acquisition game machine according to claim 2, wherein the prize placing base comprises a plurality of the leg portions.

4. A prize acquisition game machine according to claim 1, further comprising a rocking position fixing mechanism formed between the prize placing base and the support member, for fixing a rocking position of the prize placing base on the support surface.

5. A prize acquisition game machine according to claim 1, wherein the prize placing base is provided with a first inclination angle adjusting mechanism for adjusting an inclination angle of the prize placing base in the fore-and-aft direction in an initial state.

6. A prize acquisition game machine according to claim 1, wherein the support member is provided with a second inclination angle adjusting mechanism for adjusting an inclination angle of the support surface in the fore-and-aft direction.

7. A prize acquisition game machine according to claim 1, wherein the prize placing base further comprises a fall-off blocking member capable of adjusting an extension amount thereof from a front end of the placing surface in an upward direction.

8. A prize acquisition game machine according to claim 1, wherein:

the prize placing base further comprises a back plate provided upwardly from a back end of the placing surface;

the back plate has a front surface formed with a second placing surface on which the prize can be placed; and the back plate has a back surface formed with an engagement member for fixing the prize placing base to the support surface.

9. A prize acquisition game machine according to claim 1, wherein the prize placing base further comprises removable side plates which extends upright from both side ends of the placing surface.

10. A prize acquisition game machine according to claim 1, the placing surface of the prize placing base comprises a slip inhibition member arranged thereon, for inhibiting slippage of the prize.

11. A prize acquisition game machine according to claim 1, wherein:

the prize placing base comprises a rotation shaft extending in a horizontal direction;

the support member comprises a bearing for rotatably supporting the rotation shaft;

the rocking mechanism comprises the rotation shaft and the bearing; and the prize placing base rocks in the fore-and-aft direction by rotating about the rotation shaft.

12. A prize acquisition game machine according to claim 1, wherein:

the rocking mechanism comprises at least one elongated suspension member one end which is attached to the support member and another end of which is attached to the prize placing base; and the prize placing base rocks in the fore-and-aft direction by being suspended by the at least one suspension member and performing a pendular movement.

13. A prize placing base arranged on a support surface formed on a support member in a prize acquisition game machine, in which a prize falls off to be paid out due to a contact by an arm member performing an extension/contraction operation in a fore-and-aft direction, the prize placing base comprising:

a placing surface on which the prize is placed; and a leg portion attached to a lower side of the placing surface and having a contact surface curved in a convex shape, wherein the prize placing base rocks by rolling on the support member with the contact surface of the leg portion being brought into contact with the support surface.

* * * * *